US005183721A

United States Patent [19]

Kato et al.

[11] Patent Number: 5,183,721

[45] Date of Patent: Feb. 2, 1993

[54] ELECTROPHOTOGRAPHIC LIGHT-SENSITIVE MATERIAL

[75] Inventors: Eiichi Kato; Kazuo Ishii, both of Shizuoka, Japan

[73] Assignee: Fuji Photo Film Co., Ltd., Kanagawa, Japan

[21] Appl. No.: 495,953

[22] Filed: Mar. 20, 1990

[30] Foreign Application Priority Data

Mar. 20, 1989 [JP] Japan ..... 1-69011
Apr. 14, 1989 [JP] Japan ..... 1-93144

[51] Int. Cl.[5] ..... G03G 5/00
[52] U.S. Cl. ..... 430/96
[58] Field of Search ..... 430/96

[56] References Cited

U.S. PATENT DOCUMENTS 4,105,448 8/1978 Miyatuka et al. .
5,021,311 6/1991 Kato et al. ..... 430/96
5,064,737 11/1991 Kato et al. ..... 430/96

FOREIGN PATENT DOCUMENTS 0282275 9/1988 European Pat. Off. .
0307227 3/1989 European Pat. Off. ..... 430/96
0361063 4/1990 European Pat. Off. .
0363928 4/1990 European Pat. Off. .
2537581 3/1976 Fed. Rep. of Germany .

*Primary Examiner*—Marion E. McCamish
*Assistant Examiner*—S. C. Crossan
*Attorney, Agent, or Firm*—Sughrue, Mion, Zinn, Macpeak & Seas

[57] ABSTRACT

An electrophotographic light-sensitive material is disclosed. The light-sensitive material comprises a support having provided thereon a photoconductive layer containing at least inorganic photoconductive particles and a binder resin, wherein the binder comprises a copolymer comprising at least a monofunctional macromonomer (M) having a weight average molecular weight of not more than $2\times10^4$ and a monomer represented by the formula (III) as defined in the specification, the macromonomer (M) comprising at least one polymer component represented by the formulae (IIa) and (IIb) as defined in the specification and at least one polymer component containing at least one polar group, and the macromonomer (M) having a polymerizable double bond group represented by the formula (I) as defined in the specification bonded to only one terminal of the main chain of the polymer. The electrophotographic light-sensitive material has excellent electrostatic characteristics, moisture resistance and durability.

8 Claims, No Drawings

ELECTROPHOTOGRAPHIC LIGHT-SENSITIVE MATERIAL

FIELD OF THE INVENTION

This invention relates to an electrophotographic light-sensitive material, and more particularly to an electrophotographic light-sensitive material having excellent electrostatic characteristics, moisture resistance, and durability.

BACKGROUND OF THE INVENTION

An electrophotographic light-sensitive material may have various structures depending upon the characteristics required or an electrophotographic process being employed.

An electrophotographic system in which the light-sensitive material comprises a support having thereon at least one photoconductive layer and, if necessary, an insulating layer on the surface thereof is widely employed. The electrophotographic light-sensitive material comprising a support and at least one photoconductive layer formed thereon is used for the image formation by an ordinary electrophotographic process including electrostatic charging, imagewise exposure, development, and, if necessary, transfer.

Furthermore, a process of using an electrophotographic light-sensitive material as an offset master plate for direct plate making is widely practiced.

A binder which is used for forming the photoconductive layer of an electrophotographic light-sensitive material is required to be excellent in the film-forming property by itself and the capability of dispersing therein a photoconductive powder as well as the photoconductive layer formed using the binder is required to have satisfactory adhesion to a base material or support. Also, the photoconductive layer formed by using the binder is required to have various excellent electrostatic characteristics such as high charging capacity, less dark decay, large light decay, and less fatigue before light-exposure and also have an excellent photographing property that the photoconductive layer stably maintains these electrostatic properties to the change of humidity at photographing.

Binder resins which have conventionally used include silicone resins (e.g., JP-B-34-6670, the term "JP-B" as used herein means an "examined published Japanese patent publication"), styrene-butadiene resins (e.g., JP-B-35-1960), alkyd resins, maleic acid resins, polyamides (e.g., JP-B-35-11219), polyvinyl acetate resins (e.g., JP-B-41-2425), vinyl acetate copolymers (e.g., JP-B-41-2426), acrylic resins (JP-B-35-11216), acrylic acid ester copolymers (e.g., JP-B-35-11219, JP-B-36-8510, and JP-B-41-13946), etc.

However, in the electrophotographic light-sensitive materials using these binder resins, there are various problems such as 1) the affinity of the binder with photoconductive powders is poor thereby reducing the dispersibility of the coating composition containing them, 2) the charging property of the photoconductive layer containing the binder is low, 3) the quality (in particular, the dot image reproducibility and resolving power) of the imaged portions of copied images is poor, 4) the image quality is liable to be influenced by the surrounding conditions (e.g., high temperature and high humidity or low temperature and low humidity) at the formation of copies, and 5) the photoconductive layer is insufficient in film strength and adhesion, which causes, when the light-sensitive material is used for an offset master, peeling off of the photoconductive layer, etc. at offset printing to reduce the number of prints.

For improving the electrostatic characteristics of a photoconductive layer, various approaches have hitherto been taken. For example, incorporation of a compound having an aromatic ring or a furan ring containing a carboxy group or a nitro group either alone or in combination with a dicarboxylic anhydride in a photoconductive layer is disclosed in JP-B-42-6878 and JP-B-45-3073. However, the thus improved electrophotographic light-sensitive materials are yet insufficient in electrostatic characteristics and, in particular light-sensitive materials having excellent light decay characteristics have not yet been obtained. Thus, for compensating the insufficient sensitivity of these light-sensitive materials, an attempt to incorporate a large amount of a sensitizing dye in the photoconductive layer has been made. However, light-sensitive materials containing a large amount of a sensitizing dye undergo considerable deterioration of whiteness to reduce the quality as a recording medium, sometimes causing deterioration in dark decay characteristics, thereby satisfactory reproduced images are not obtained.

On the other hand, JP-A-60-10254 (the term "JP-A" as used herein means an "unexamined published Japanese patent application") discloses a method of using a binder resin for a photoconductive layer by controlling the average molecular weight of the resin. That is, JP-A-60-10254 discloses a technique of improving the electrostatic characteristics (in particular, reproducibility at repeated use as a PPC light-sensitive material), humidity resistance, etc., of the photoconductive layer by using an acrylic resin having an acid value of from 4 to 50 and an average molecular weight of from $1\times10^3$ to $1\times10^4$ and the acrylic resin having an average molecular weight of from $1\times10^4$ to $2\times10^5$.

Furthermore, lithographic printing master plates using electrophotographic light-sensitive materials have been extensively investigated and, as binder resins for a photoconductive layer having both the electrostatic characteristics as an electrophotographic light-sensitive material and the printing characteristics as a printing master plate, there are, for example, a combination of a resin having a molecular weight of from $1.8\times10^4$ to $10\times10^4$ and a glass transition point (Tg) of from 10° to 80° C. obtained by copolymerizing a (meth)-acrylate monomer and other monomer in the presence of fumaric acid and a copolymer composed of a (meth)-acrylate monomer and a copolymerizable monomer other than fumaric acid as disclosed in JP-B-50-31011, a terpolymer containing a (meth)acrylic acid ester unit with a substituent having a carboxylic acid group at least 7 atoms apart from the ester linkage as disclosed in JP-A-53-54027, a tetra- or pentapolymer containing an acrylic acid unit and a hydroxyethyl (meth)acrylate unit as disclosed in JP-A-54-20735 and JP-A-57-202544, and a terpolymer containing a (meth)acrylic ester unit with an alkyl group having from 6 to 12 carbon atoms as a substituent and a vinyl monomer containing a carboxyl group as disclosed in JP-A-58-68046.

However, none of these resins proposed have proved to be satisfactory for practical use in charging property, dark charge retention, electrostatic characteristics for photosensitivity, and the surface smoothness of the photoconductive layer.

Also, the practical evaluations on conventional binder resins which are said to be developed for electrophotographic lithographic master plates have found that they have problems in the aforesaid electrostatic characteristics, background staining of prints, etc.

For solving these problems, JP-A-63-217354 describes that the smoothness and the electrostatic characteristics of a photoconductive layer can be improved and images having no background staining are obtained by using a low-molecular weight resin (molecular weight of from 1,000 to 10,000) containing from 0.05 to 10% by weight a copolymer component having an acid group at the side chain of the copolymer as the binder resin, and also Japanese Patent Application 63-49817 and JP-A-63-220148 and JP-A-63-220149 describe that the film strength of a photoconductive layer can be sufficiently increased to improve the printing durability without reducing the aforesaid characteristics by using the aforesaid low-molecular resin in combination with a high-molecular resin (molecular weight of 10,000 or more).

However, it has been found that even in the case of using these resins, it is yet insufficient to keep the stable performance in the case of greatly changing the environmental conditions from high-temperature and high-humidity to a low-temperature and low-humidity. In particular, in a scanning exposure system using a semiconductor laser light, the exposure time becomes longer and also there is a restriction on the exposure intensity as compared to a conventional overall simultaneous exposure system using a visible light, and hence a higher performance has been required for the electrostatic characteristics, in particular, the dark charge retention characteristics and photosensitivity.

SUMMARY OF THE INVENTION

The invention has been made for solving the problems of conventional electrophotographic light-sensitive materials as described above and meeting the requirement for the light-sensitive materials.

An object of this invention is to provide an electrophotographic light-sensitive material having stable and excellent electrostatic characteristics and giving clear good images even when the environmental conditions during the formation of duplicated images are changed to a low-temperature and low-humidity or to high-temperature and high-humidity.

Another object of this invention is to provide a CPC electrophotographic light-sensitive material having excellent electrostatic characteristics and showing less environmental reliance.

A further other object of this invention is to provide an electrophotographic light-sensitive material effective for a scanning exposure system using a semiconductor laser beam.

A still further object of this invention is to provide an electrophotographic lithographic printing master plate having excellent electrostatic characteristics (in particular, dark charge retentivity and photosensitivity), capable of reproducing faithful duplicated images to original, forming neither overall background stains nor doted background stains of prints, and showing excellent printing durability.

It has now been discovered that the above and other objects can be attained by the present invention as described hereinbelow.

That is, the present invention relates to an electrophotographic light-sensitive material comprising a support having provided thereon a photoconductive layer containing at least inorganic photoconductive particles and a binder resin, wherein the binder resin comprises a copolymer (hereinafter, is sometimes referred to as resin (A)) comprising at least a monofunctional macromonomer (M) having a weight average molecular weight of not more than about $2\times10^4$ and a monomer represented by the following formula (III), the macromonomer (M) comprising at least one polymer component represented by the following formulae (IIa) and (IIb) and at least one polymer component containing at least one polar group selected from —COOH, $-PO_3H_2$, $-SO_3H$, —OH, and

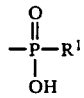

(wherein $R^1$ represents a hydrocarbon group or $-OR^2$ (wherein $R^2$ represents a hydrocarbon group)) and the macromonomer (M) having a polymerizable double bond group represented by the following formula (I) bonded to only one terminal of the main chain of the polymer;

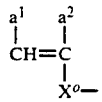

(I)

wherein $X^o$ represents —COO—, —OCO—, $-CH_2OCO-$, $-CH_2COO-$, —O—, $-SO_2-$, —CO—,

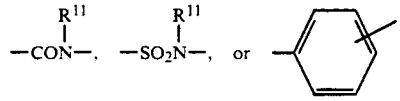

(wherein $R^{11}$ represents a hydrogen atom or a hydrocarbon group), and $a^1$ and $a^2$, which may be the same or different, each represents a hydrogen atom, a halogen atom, a cyano group, a hydrocarbon group, $-COO-Z^1$ or $-COO-Z^1$ bond via a hydrocarbon group (wherein $Z^1$ represents a hydrogen atom or a hydrocarbon group which may be substituted);

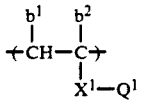

(IIa)

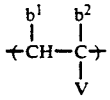

(IIb)

wherein $X^1$ has the same meaning as $X^o$ in formula (I); $Q^1$ represents an aliphatic group having from 1 to 18 carbon atoms or an aromatic group having from 6 to 12 carbon atoms; $b^1$ and $b^2$, which may be the same or different, have the same meaning as $a^1$ and $a^2$ in formula (I): and V represents —CN, $-CONH_2$, or

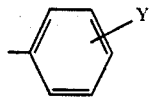

where Y represents a hydrogen atom, a halogen atom, an alkoxy group or —$COOZ^2$ (wherein $Z^2$ represents an alkyl group, an aralkyl group, or an aryl group));

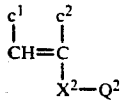

(III)

wherein $X^2$ has the same meaning as $X^o$ in formula (I); $Q^2$ has the same meaning as $Q^1$ in formula (IIa): and $c^1$ and $c^2$, which may be the same of different, have the same meaning as $a^1$ and $a^2$ in formula (I).

It has also been discovered that the aforesaid objects of this invention can be attained by an electrophotographic light-sensitive material comprising a support having provided thereon a photoconductive layer containing at least inorganic photoconductive particles and a binder resin, wherein the binder comprises at least the resin (A) described above and at least one of a heat- and/or photo-curable resin (E) having at least one crosslinking functional group and a crosslinking agent.

That is, the binder resin for the aforesaid embodiment of this invention comprises the graft type copolymer or the resin (A) comprising the monofunctional macromonomer (M) and a monomer shown by formula (III) described above and at least one of the heat- and/or photo-curable resin (E) and a crosslinking agent each forming a crosslinking structure among the polymers.

The graft type copolymer (resin (A)) for use in this invention may have at least one polar group selected from —$PO_3H_2$, —$SO_3H$, and —COOH (hereinafter, the resin is sometimes referred to as resin (A')).

It has further been discovered that the mechanical strength (the printing durability in the case of using the light-sensitive material as a printing plate after processing) of the electrophotographic light-sensitive material of this invention is further improved in another embodiment of this invention as described below. That is, the binder resin for the electrophotographic light-sensitive material in the embodiment comprises at least the aforesaid resin (A) having, however, a low weight average molecular weight of from $1\times10^3$ to $2\times10^4$ (hereinafter, the low molecular weight resin (A) is referred to resin (AL)) or the aforesaid resin (A) having a low weight average molecular weight of from $1\times10^3$ to $2\times10^4$ and having at least one polar group selected from —$PO_3H_2$, —$SO_3H$, and —COOH bonded to one terminal of the polymer main chain (hereinafter, the low molecular weight resin (A) having the acid group is referred to as resin (AL')) and at least one of following resins (B), (C), and (D).

Resin (B): A resin having a weight average molecular weight of from $5\times10^4$ to $5\times10^5$ and not having —$PO_3H_2$, —$SO_3H$, —$CO_2H$, —OH,

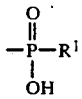

(wherein $R^1$ is same as defined above) and a basic group.

Resin (C): A resin having a weight average molecular weight of from $5\times10^4$ to $5\times10^5$ and containing from 0.1 to 15% by weight a copolymer component having at least one functional group selected from —OH and a basic group.

Resin (D): A resin having a weight average molecular weight of from $5\times10^4$ to $5\times10^5$ and containing a copolymer component having an acid group at a content of less than 50% of the content of the polar group (i.e., —COOH, —$PO_3H_2$, —$SO_3H$, and

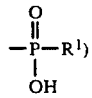

contained in the afore- the copolymer (resin (A) or resin (A')) or a resin having a weight average molecular weight of from $5\times10^4$ to $5\times10^5$ and containing a copolymer having at least one polar group selected from —$PO_3H_2$, —$SO_3H$, —COOH, and

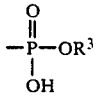

(wherein $R^3$ represents a hydrocarbon group), the polar group having a pKa value larger than the pKa of the polar group contained in the aforesaid copolymer (resin (A) or resin (A')).

DETAILED DESCRIPTION OF THE INVENTION

The present invention is described hereinafter in detail.

The resin (A) contained in the binder resin in this invention is a graft type copolymer comprising the mono-functional macromonomer (M) and a monomer shown by formula (III) described above or the aforesaid graft type copolymer having further the aforesaid specific polar group at only one terminal of the polymer main chain (resin (A')).

The weight average molecular weight of the graft type copolymer is suitably from about $1\times10^3$ to about $5\times10^5$. From the view point of the electrophotographic characteristics, the weight average molecular weight thereof is preferably from $1\times10^3$ to $1.5\times10^4$, and particularly preferably from $3\times10^3$ to $1\times10^4$.

The resin (A) for use in this invention contains the macromonomer as a copolymer component in a proportion of from 1 to 70parts by weight per 100 parts by weight of the resin and a monomer shown by formula (III) as other copolymer component in a proportion of from 30 to 90 parts by weight of the resin.

When the resin has the polar group at the terminal of the main chain thereof, the content of the polar group in the resin is from 0.1 to 10 parts by weight per 100 parts by weight of the resin.

When the resin (A) for use in this invention has a low weight average molecular weight of from $1\times10^3$ to $1.5\times10^4$, it is preferred that the content of the aforesaid macromonomer (M) is from 40 to 70 parts by weight per 100 parts by weight of the resin and the content of the acid group bonded at the terminal of an optional chain is from 3 to 10 parts by weight per 100 parts by weight of the polymer. On the other hand, when the resin (A) has a high weight average molecular weight of from $7\times10^4$ to $5\times10^5$, it is preferred that the content of the macromonomer (M) is from 1 to 40 parts by weight per 100 parts by weight of the resin and the content of the acid group bonded to the terminal of an optional main chain is from 0 to 2 parts by weight per 100 parts by weight of the resin.

A conventionally known acid group-containing binder resin as described hereinbefore is mainly for offset master, the molecular weight is large for improving the printing impression by keeping the high film strength (e.g., larger than $5\times10^4$), and the resin is a random copolymer in which polar group-containing copolymer components randomly exist in the main chain of the polymer.

On the other hand, the resin (A) in the binder resin for use in this invention is a graft type copolymer and in the copolymer, the polar group or hydroxy group does not randomly exist in the polymer main chain but exists at a specific position, i.e., randomly exists in the grafted portion only or exists at the terminal of the main chain of the copolymer.

Accordingly, it is assumed that the polar group portion existing at a specific position apart from the main chain of the copolymer adsorbs onto stoichiometric defects on an inorganic photoconductor and the main chain portions of the copolymer mildly and sufficiently covers the surface of the photoconductor. Thus, in the case of using the resin (A), electron traps of the photoconductor can be compensated as well as the humidity resistance is improved, and also photoconductive particles can be sufficiently dispersed in the binder resin, whereby the occurrence of aggregation of the particles can be prevented.

That is, when the resin having the low weight average molecular weight is used, the covering property on the surface of photoconductive particles is more improved and, when the resin having the high molecular weight is used, the acceleration of the aggregation of photoconductive particles with each other, which occurs remarkably in the case of using a conventional random copolymer, is inhibited. Thus, the surface of the photoconductive layer becomes smooth.

On the other hand, when an electrophotographic light-sensitive material having a photoconductive layer of rough surface is used as an electrophotographic lithograhic printing master plate after processing, the non-image portions of the photoconductive layer is not uniformly and sufficiently rendered hydrophilic in the case of applying thereto an oil-desensitizing treatment by an oil-desensitizing solution since the dispersion state of photoconductive particles such as zinc oxide particles and the binder resin is not appropriate and thus the photoconductive layer is formed in a state containing the aggregates thereof, thereby a print ink is attached to the non-image portion at printing to cause background staining at non-image portions of prints.

On the other hand, in the case of using the resin (A) in this invention having a low molecular weight, it might be feared that the film strength of the photoconductive layer became brittle, but it has been found that by sufficiently dispersing photoconductive particles in the binder resin to cover the surface of the particles by the adsorption of the resin, the photoconductive layer keeps a sufficient filming property and also maintains a sufficient film strength for a CPC light-sensitive material or for an offset master plate capable of printing several thousands prints. Furthermore, it has been found that the aforesaid photoconductive layer has a higher light-sensitivity than that of a photoconductive layer containing a conventional random copolymer resin having a polar group at the side chain bonded to the main chain of the polymer.

Since spectral sensitizing dyes which are used for giving light sensitivity in the region of visible light to infrared light have a function of sufficiently showing the spectral sensitizing action by adsorbing on photoconductive particles, it can be assumed that the binder resin containing the resin (A) in this invention makes suitable interaction with photoconductive particles without hindering the adsorption of spectral sensitizing dyes onto the photoconductive particles. This effect is particularly remarkable in cyanine dyes or phthalocyanine dyes which are particularly effective as spectral sensitizing dyes for the region of near infrared to infrared light.

When the low molecular weight resin (AL) is used alone for the binder resin in this invention, the binder resin sufficiently adsorbs onto photoconductive particles to cover the surface of the particles, whereby the photoconductive layer formed is excellent in the surface smoothness and electrostatic characteristics, image quality having no background stains is obtained, and further the layer maintains a sufficient film strength for CPC light-sensitive materials or for an offset printing master plate giving several thousands of prints.

In this case, when the heat- and/or photo-curable resin (E) or a crosslinking agent is used together with the resin (A) for the binder resin, a crosslinking structure is formed between the resins (preferably, between the resin (A) and the resin (E) in the case of using the resin (E)), the mechanical strength of the photoconductive layer, which is yet insufficient by the use of the resin (A) only, can be more improved without reducing the function of the resin (A).

Accordingly, the electrophotographic light-sensitive material of this invention has excellent electrostatic characteristics even when environmental condition is changed, has a sufficient film strength, and, when the light-sensitive material is used as an offset printing master plate after processing, from 6,000 to 7,000 prints are obtained under severe printing conditions (e.g., when a printing pressure is strong using a large printing machine).

Also, for accelerating the aforesaid crosslinking reaction, a catalyst may be added or the resin (A) may be use together with both the heat- and/or photo-curable resin (E) and a crosslinking agent.

The weight average molecular weight of the resin (A) is from $1\times10^3$ to $5\times10^5$, and preferably from $1\times10^3$ to $1.5\times10^4$, the content of the macromonomer (M) in the resin (A) is at least 30% by weight, and preferably from 50 to 97% by weight, and, when the resin (A) has the polar group at the terminal of the main chain of the copolymer, the content of the polar group in the copolymer is from 0.5 to 15% by weight, and preferably from 1 to 10% by weight. Furthermore, the glass transition point of the resin (A) is preferably from −20° C. to 120° C., and more preferably from −5° C. to 90° C.

If the molecular weight of the resin (A) is less than $1\times10^3$, the film-forming capacity is reduced and a sufficient film strength is not maintained, whereas, if the molecular weight is larger than $5\times10^5$, the electrophotographic characteristics (in particular, initial potential and dark decay retentivity) using such a resin are undesirably reduced. In particular, in the case of using the resin of such a higher molecular weight, the deterioration of the electrophotographic characteristics is severe if the content of the polar group is over 3% by weight, and in the case of using the light-sensitive material as an offset master plate, the occurrence of background staining becomes severe.

If the content of the polar group (the polar group in the grafted portion and the polar group at the terminal of an optional main chain) is less than 0.5% by weight, the initial potential is low and thus satisfactory image density can not be obtained. On the other hand, if the content of the polar group or the polar group is larger than 10% by weight, the dispersibility is reduced, the film smoothness of the photoconductive layer and the high humidity characteristics of the electrophotographic characteristics are reduced, and further when the light-sensitive material is used as an offset master plate, the occurrence of background stains is increased.

Then, the mono-functional macromonomer (M) which is a copolymer component of the graft type copolymer resin (A) for use in this invention is described hereinafter in greater detail.

The mono-functional macromonomer (M) is a macromonomer having a weight average molecular weight of less than $2\times10^4$, comprising at least a copolymer component shown by formula (IIa) or (IIb) described above and at least one copolymer component having at least one specific polar group (i.e., —COOH, $—PO_3H_2$, $—SO_3H$, —OH, and/or

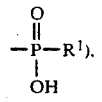

and having a polymerizable double bond group at only one terminal of the polymer main chain.

In the aforesaid formulae (I), (IIa), and (IIb), the hydrocarbon groups shown by $a^1$, $a^2$, $X^o$, $b^1$, $b^2$, $X^1$, $Q^1$, and V each has the number of carbon atoms shown above (as unsubstituted hydrocarbon group) and these hydrocarbon groups may have substituents.

In formula (I), $X^o$ represents —COO—, —OCO—, $—CH_2OCO—$, $—CH_2COO—$, —O—, $—SO_2—$, —CO—,

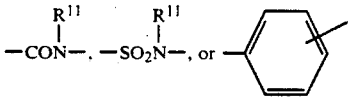

wherein $R^{11}$ represents a hydrogen atom or a hydrocarbon group, and preferred examples of the hydrocarbon group include an alkyl group having from 1 to 18 carbon atoms which may be substituted (e.g., methyl, ethyl, propyl, butyl, heptyl, hexyl, octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-porpenyl, 2-butenyl, 2-pentenyl, 3-methyl-2-pentenyl, 1-pentenyl, 1-hexenyl, 2-hexenyl, and 4-methyl-2-hexcenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl,, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

When $X^o$ represents

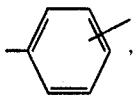

the benzene ring may have a substituent such as, for example, a halogen atom (e.g., chlorine and bromine), an alkyl group (e.g., methyl, ethyl, propyl, butyl, chloromethyl, methoxymethyl) and an alkoxy group (e.g., methoxy, ethoxy, propoxy, and butoxy).

In formula (I), $a^1$ and $a^2$, which may be the same or different, each represents a hydrogen atom, a halogen atom (e.g., chlorine and bromide), a cyano group, an alkyl group having from 1 to 4 carbon atoms (e.g., methyl, ethyl, propyl, and butyl), $—COO—Z^1$, or $—COO—Z^1$ bonded via a hydrocarbon group (wherein $Z^1$ represents preferably a hydrogen atom, an alkyl group having from 1 to 18 carbon atoms, an alkenyl group, an aralkyl group, an alicyclic group or an aryl group, these groups may be substituted, and practical examples thereof are the same as those described above for $R^{11}$).

In formula (I), $—COO—Z^1$ may be bonded via a hydrocarbon group, and examples of the hydrocarbon group are methylene, ethylene, and propylene.

In formula (I), $X^o$ is more preferably —COO—, —OCO—, $—CH_2COO—$, $—CH_2COO—$, —O—, —CONH—, $—SO_2NH—$, or

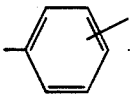

Also, $a^1$ and $a^2$, which may be the same or different, each represents more preferably a hydrogen atom, a methyl group, $—COOZ^1$, or $—CH_2COOZ^1$ (wherein $Z^1$ represents more preferably a hydrogen atom or an alkyl group having from 1 to 6 carbon atoms (e.g., methyl, ethyl, propyl, butyl, and hexyl)). Most preferably, one of $a^1$ and $a^2$ represents a hydrogen atom.

That is, specific examples of the polymerizable double bond shown by formula (I) are

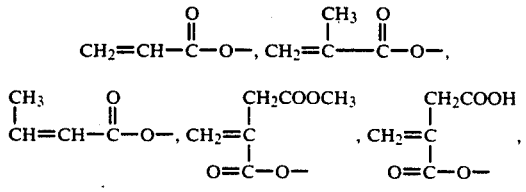

-continued $CH_2{=}CH{-}CONH{-}$, $CH_2{=}C(CH_3){-}CONH{-}$, $CH(CH_3){=}CH{-}CONH{-}$, $CH_2{=}CH{-}O{-}C(=O){-}$, $CH_2{=}CH{-}CH_2{-}O{-}C(=O){-}$, $CH_2{=}CH{-}O{-}$, $CH_2{=}C(COOH){-}CH_2{-}C(=O){-}O{-}$, $CH_2{=}C(COOCH_3){-}CH_2{-}C(=O){-}O{-}$, and

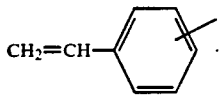

In formula (IIa) or (IIb), $X^1$ has the same meaning as $X^o$ in formula (I) and $b^1$ and $b^2$, which may be the same or different, have the same meaning as $a^1$ and $a^2$ in formula (I).

$Q^1$ represents an aliphatic group having from 1 to 18 carbon atoms or an aromatic group having from 6 to 12 carbon atoms.

Specific examples of the aliphatic group are an alkyl group having from 1 to 18 carbon atoms which may be substituted (e.g., methyl, ethyl, propyl, butyl, heptyl, hexyl, octyl, decyl, dodecyl, tridecyl, hexadecyl, octadecyl, 2-chloroethyl, 2-bromoethyl, 2-hydroxyethyl, 2-methoxyethyl, 2-ethoxyethyl, 2-cyanoethyl, 3-chloropropyl, 2-(trimethoxysilyl)ethyl, 2-tetrahydrofuryl, 2-ethienylethyl, 2-N,N-dimethylaminoethyl, and 2-N,N-diethylaminoethyl), a cycloalkyl group having from 5 to 8 carbon atoms (e.g., cycloheptyl, cyclohexyl, and cyclooctyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, dichlorobenzyl, methylbenzyl, chloromethylbenzyl, dimethylbenzyl, trimethylbenzyl, and methoxybenzyl), etc. Also, specific examples of the aromatic group are an aryl group having from 6 to 12 carbon atoms which may be substituted (e.g., phenyl, tolyl, xylyl, chlorophenyl, bromophenyl, dichlorophenyl, chloromethylphenyl, methoxyphenyl, methoxycarbonylphenyl, naphthyl, and chloronaphthyl).

In formula (IIa), $X^1$ represents preferably —COO—, —OCO—, $—CH_2COO—$, $—CH_2OCO—$, —O—, —CO—, —CONH—, $—SO_2NH—$, or

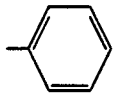

Also, preferred examples of $b^1$ and $b^2$ are same as those described above on $a^1$ and $a^2$ in formula (I).

In formula (IIb), V represents —CN, $—CONH_2$, or

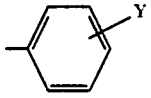

(wherein Y represents a halogen atom (e.g., chlorine and bromine), an alkoxy group (e.g., methoxy, ethoxy, propoxy, and butoxy), or $—COOZ^2$ (wherein $Z^2$ represents an alkyl group having from 1 to 8 carbon atoms, an aralkyl group having from 7 to 12 carbon atoms or an aryl group)).

The mono-functional macromonomer (M) in this invention may have two or more polymer components shown by formula (IIa) and/or the polymer components shown by formula (IIb). Also, when $Q^1$ in formula (IIa) is an aliphatic group having from 6 to 12 carbon atoms, it is preferred that the proportion of the aliphatic group is not higher than 20% by weight of the whole polymer components in the macromonomer (M).

Furthermore, when $X^1$ in formula (IIa) is —COO—, it is preferred that the proportion of the polymer component shown by (IIa) is at least 30% by weight of the whole polymer components in the macromonomer (M).

As the polymer component having the polar groups $$(—COOH,\ —PO_3H_2,\ —SO_3H,\ —OH,\ \text{or}\ —P(=O)(OH)—R^1),$$

which is copolymerized with the copolymer component shown by formula (IIa) or (IIb) in the macromonomer (M), any vinylic compounds having the aforesaid polar group capable of copolymerized with the copolymer component shown by formula (IIa) or (IIb) can be used.

Examples of these vinylic compounds are described in *Macromolecule Data Handbood (Foundation),* edited by Kobunshi Gakkai, published by Baifukan K. K., 1986.

Specific examples thereof are acrylic acid, α- and/or β-substituted acrylic acid (e.g., α-aminomethyl compound, α-chloro compound, α-bromo compound, α-fluoro compound, α-tributylsilyl compound, α-cyano compound, β-chloro compound, β-bromo compound, α-chloro compound, β-methoxy compound, and α, β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenic acid, 2-octenoic acid, 4-methyl-2-hexenic acid, and 4-ethyl-2-octenoic acid), maleic acid, maleic acid half esters, maleic acid half esters, vinylbenzenecarboxylic acid, vinylbenzenesulfonic acid, vinylsulfonic acid, vinylphosphonic acid, dicarboxylic acids, half ester derivatives of alcohols at the vinyl group or allyl group, and compounds having the polar group in the substituent of amido derivatives.

In $$—P(=O)(OH)—R^1,$$

$R^1$ represents a hydrocarbon group or $—OR^2$ and $R^2$ represents a hydrocarbon group. Examples of these hydrocarbon groups are those described above on $Q^1$ in formula (IIa).

Practical examples of OH group are alcohols having a vinyl group or an allyl group (e.g., allyl alcohol, methacrylic acid esters, acrylamide, and compounds having —OH in the N-substituent), and methacrylic acid esters or amides having a hydroxyphenyl group or a hydroxyphenol group as a substituent.

Then, specific examples of the monomer or polymer component having the polar group described above are illustrated but the invention is not limited to them.

In addition, in the following formulae, a represents —H, —$CH_3$, —Cl, —Br, —CN, —$CH_2COOCH_3$, or —$CH_2COOH$; b represents —H or —$CH_3$; j represents an integer of from 2 to 18; k represents an integer of from 2 to 5; l represents an integer of from 1 to 4; and m represents an integer of from 1 to 12.

(A-1)

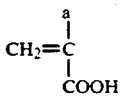

(A-2)

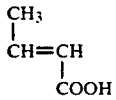

(A-3)

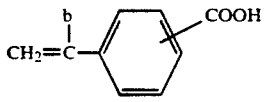

(A-4)

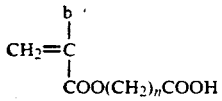

(A-5)

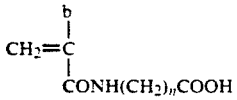

(A-6)

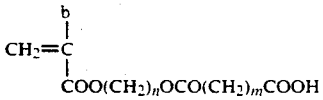

(A-7)

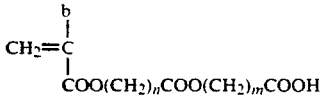

(A-8)

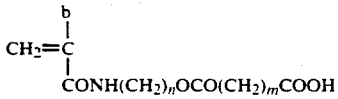

(A-9)

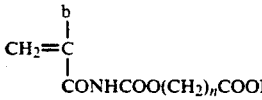

(A-10)

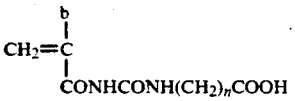

(A-11)

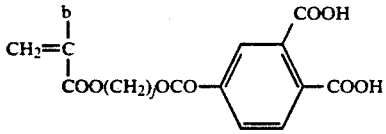

(A-12)

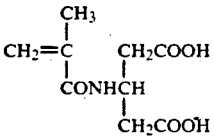

-continued (A-13)

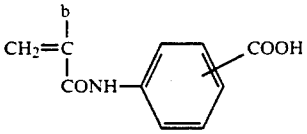

(A-14)

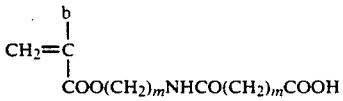

(A-15)

$CH_2=CH-CH_2OCO(CH_2)_mCOOH$ (A-16)

$CH_2=CH\leftarrow CH_2\rightarrow_{\overline{n}}COOH$ (A-17)

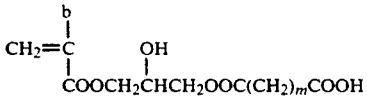

(A-18)

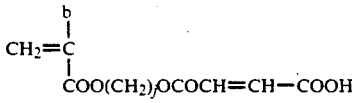

(A-19)

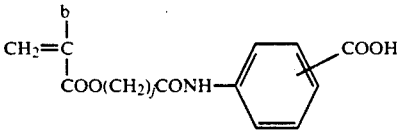

(A-20)

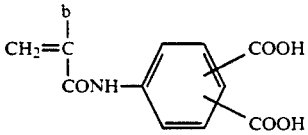

(A-21)

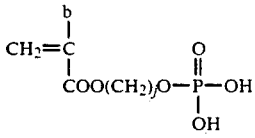

(A-22)

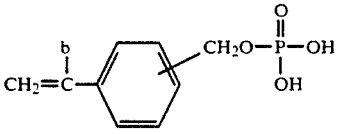

(A-23)

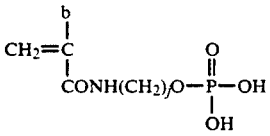

(A-24)

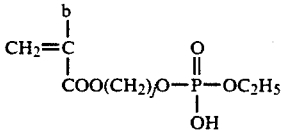

(A-25)

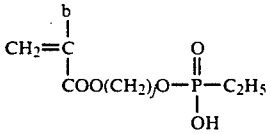

-continued
(A-26)
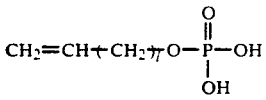
(A-27)
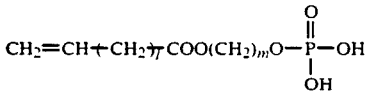
(A-28)
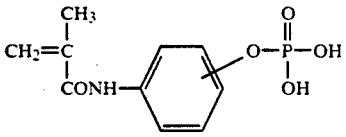
(A-29)
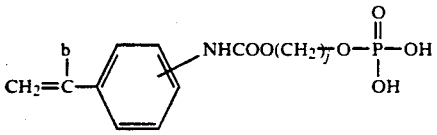
(A-30)
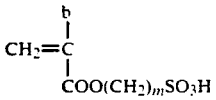
(A-31)
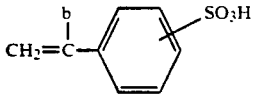
(A-32)
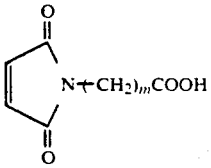
(A-33)
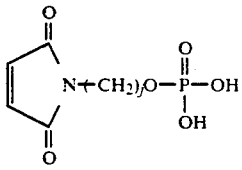
(A-34)
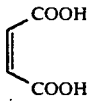
(A-35)
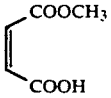
(A-36)
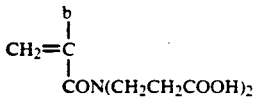
(A-37)
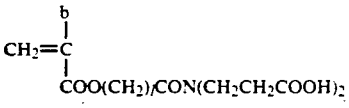
-continued
(A-38)
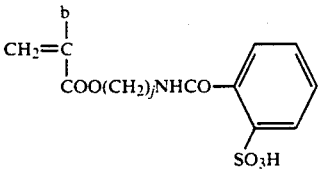
(A-39)
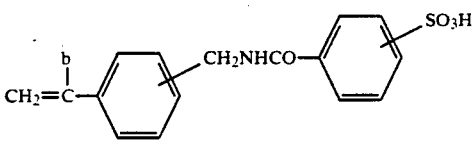
(A-40)
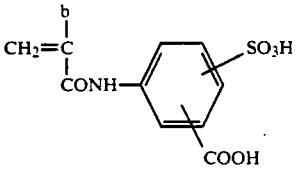
(A-41)
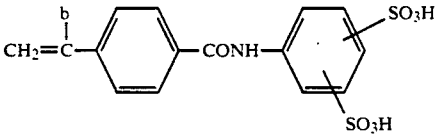
(A-42)
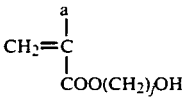
(A-43)
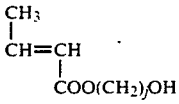
(A-44)
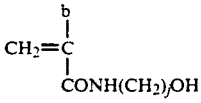
(A-45)
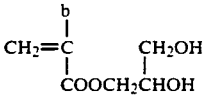
(A-46)
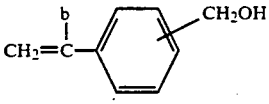
(A-47)
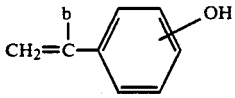
(A-48)
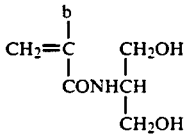
(A-49)
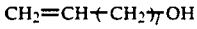

-continued (A-50)

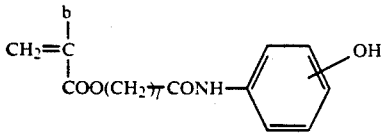

(A-51)

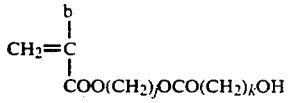

(A-52)

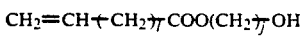

(A-53)

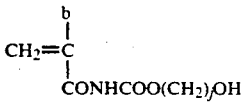

(A-54)

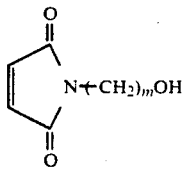

(A-55)

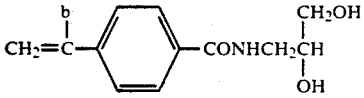

(A-56)

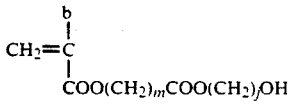

The content of the aforesaid copolymer components having the polar group contained in the macromonomer (M) is preferably from 0.5 to 50 parts by weight, and more preferably from 1 to 40 parts by weight per 100 parts by weight of the total copolymer components.

When the mono-functional macromonomer composed of the random copolymer having the polar group exists in the resin (A) as a copolymer component, the total content of the polar group-containing component contained in the total grafted portions in the resin (A) is preferably from 0.1 to 10 parts by weight per 100 parts by weight of the total copolymer components in the resin (A). When the resin (A) has the polar group selected from —COOH, —$SO_3H$, and —$PO_3H_2$, the total content of the polar group in the grafted portions of the resin (A) is more preferably from 0.1 to 5 parts by weight.

The macromonomer (M) may further contain other copolymer component(s) in addition to the aforesaid copolymer components.

As such a monomer corresponding to other polymerizable recurring unit, there are acrylonitrile, methacrylonitrile, acrylamides, methacrylamides, styrene, styrene derivatives (e.g., vinyltoluene, chlorostyrene, dichlorostyrene, bromostyrene, hydroxymethylstyrene, and N,N-dimethylaminomethylstyrene), and heterocyclic vinyls (e.g., vinylpyridine, vinylimidazole, vinylpyrrolidone, vinylthiophene, vinylpyrazole, vinyldioxane and vinyloxazine).

When the macromonomer (M) contains other monomer described above, the content of the monomer is preferably from 1 to 20 parts by weight per 100 parts by weight of the total copolymer components in the macromonomer.

The macromonomer (M) for use in this invention has a chemical structure that the polymerizable double bond group shown by formula, (I) is bonded directly or by an optional linkage group to one terminal only of the main chain of the random polymer composed of at least the recurring unit shown by formula (IIa) and/or the recurring unit shown by formula (IIb) and at least the recurring unit having the specific polar group.

The linkage group bonding the component shown by formula (I) to the component shown by (IIa) or (IIb) or the polar group-containing component includes a carbon-carbon bond (single bond or double bond), carbon-hetero atom bond (examples of the hetero atom are oxygen, sulfur, nitrogen, and silicon), and a hetero atom-hetero atom bond, or an optional combination of these atomic groups.

Specific examples of the linkage group are a single linkage group selected from

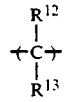

(wherein $R^{12}$ and $R^{13}$ each represents a hydrogen atom, a halogen atom (e.g., fluorine, chlorine, and bromine), a cyano group, a hydroxy group, or an alkyl group (e.g., methyl, ethyl, and propyl),

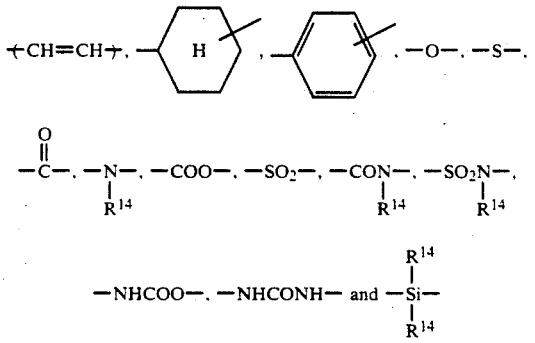

(wherein $R^{14}$ represents a hydrogen atom or the hydrocarbon group as described above for $Q^1$ in formula (IIa)) and a linkage group composed of 2 or more of these atomic groups.

If the weight average molecular weight of the macromonomer (M) is over $2\times10^4$, the copolymerizing property with the monomer shown by formula (III) is undesirably reduced. On the other hand, if the weight average molecular weight of the macromonomer is too small, the effect of improving the electrophotographic characteristics of the photoconductive layer is reduced. Thus, the weight average molecular weight is preferably from $1\times10^3$ to $2\times10^4$.

The macromonomer (M) for use in this invention can be produced by known synthesis methods.

Practically, the macromonomer can be synthesized by a radical polymerization method of forming the macromonomer by reacting an oligomer having a reactive group bonded to the terminal and various reagents. The oligomer used above can be obtained by a radical polymerization using a polymerization initiator and/or a chain transfer agent each having a reactive group such as a carboxy group, a carboxyhalide group, a hydroxy group, an amino group, a halogen atom, an epoxy group, etc., in the molecule thereof.

Practical methods for producing the macromonomer (M) are described in P. Dreyfuss & R. P. Quirk, *Encycl. Polym. Sci. Eng.*, 7, 551 (1987), P. F. Rempp & E. Franta, *Adu. Polym Sci.*, 58, 1 (1984), Yusuke Kawakami, *Kagaku Kogyo (Chemical Industry)*, 38, 56 (1987), Yuya Yamashita, *Kobunshi (Macromolecule)*, 31, 988 (1982), Shiro Kobayashi, *Kobunshi (Macromolecule)*, 35, 262 (1986), Kishiro Higashi & Takashi Tsuda, *Kino Zairyo (Functional Materials)*, 1987, No. 10, 5, and the literatures and patents cited in these references.

However, since the macromonomer (M) in this invention has the aforesaid polar group as the components of the recurring unit, the following matters should be considered in the synthesis thereof.

In one method, the radical polymerization and the introduction of a terminal reactive group are carried out by the aforesaid method using a monomer having the polar group as the form of a protected functional group as shown, for example, in the following reaction formula (I).

Reaction Scheme (I)

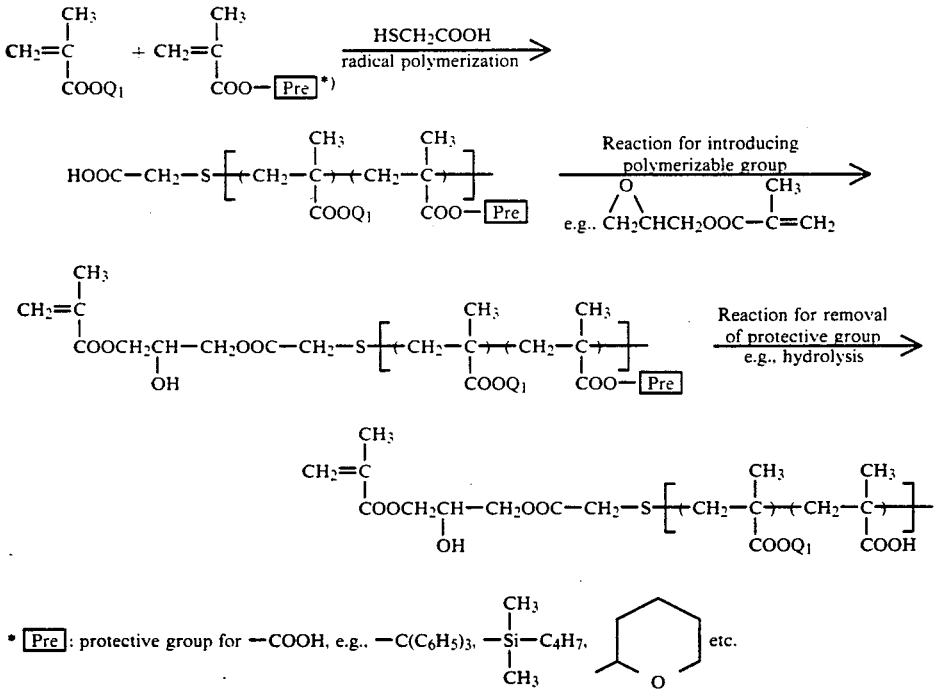

The reaction for introducing the protective group and the reaction for removal of the protective group (e.g., hydrolysis reaction, hydrogenolysis reaction, and oxidation-decomposition reaction) for the polar group ($-SO_3H$, $-PO_3H_2$, —COOH,

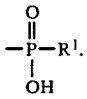

and —OH) which is randomly contained in the macromonomer (M) for use in this invention can be carried out by any of conventional methods.

These methods are practically described in J. F. W. McOmie, *Protective Groups in Organic Chemistry*, Plenum Press (1973), T. W. Greene, *Protective Groups in Organic Synthesis*, John Wiley & Sons (1981), Ryoohei Oda, *Macromolecular Fine Chemical*, Koodansha K. K., (1976), Yoshio Iwakura and Keisuke Kurita, *Hannosei Kobunshi (Reactive Macromolecules)*, Koodansha K. K. (1977), G. Gerner, et al, *J. Radiation Curing*, No. 10, 10(1986), JP-A-62-212669, JP-A-62-286064, JP-A-62-210475, JP-A-62-195684, JP-A-62-258476, JP-A-63-260439, Japanese Patent Applications 62-220510, and 62-226692.

Another method for producing the macromonomer (M) comprises synthesizing the oligomer in the same manner as described above and then reacting the oligomer with a reagent having a polymerizable double bond group which reacts with only "specific reactive group" bonded to one terminal by utilizing the difference between the reactivity and the "specific reactive group" and the reactivity of the polar group contained in the oligomer as shown in the following reaction formula (II).

Reaction Scheme (II)

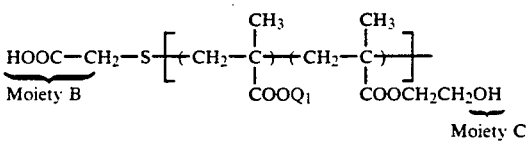

-continued

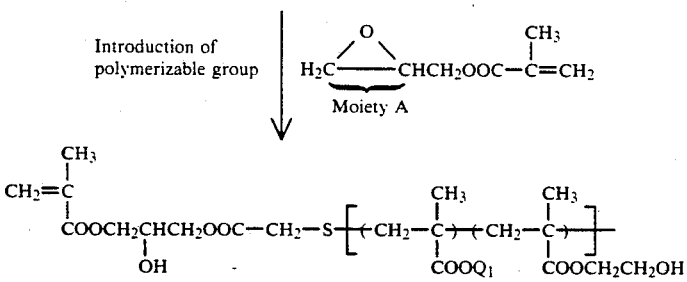

Specific examples of a combination of the specific functional groups (moieties A, B, and C) shown in the reaction formula (II) are shown in Table A below but the present invention is not limited thereto. It is important to utilize the selectivity of reaction in an ordinary organic chemical reaction and the macromonomer may be formed without protecting the polar group in the oligomer. In Table A, Moiety A is a functional group in the reagent for introducing a polymerizable group, Moiety B is a specific functional group at the terminal of oligomer, and Moiety C is a polar group in the recurring unit in the oligomer.

TABLE A

| Moiety A | Moiety B | Moiety C |
|---|---|---|
| 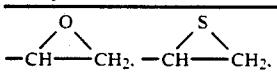 | —COOH. —$NH_2$ | —OH |
| 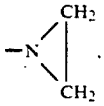 . —Halogen (Br. I. Cl) | | |
| —COCl. Acid Anhydride | —OH. —$NH_2$ | —COOH. —$SO_3H$. —$PO_3H_2$. |
| —$SO_2Cl$. | | 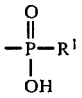 |
| —COOH. —$NHR^{15}$ (wherein $R^{15}$ is a hydrogen atom or an alkyl group) | —Halogen | —COOH. —$SO_3H$. —$PO_3H_2$. —OH. 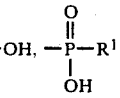 |
| —COOH. —$NHR^{15}$ | 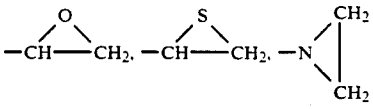 | —OH |
| —OH. —$NHR^{15}$ | —COCl. —$SO_2Cl$ | —COOH. —$SO_3H$. —$PO_3H_2$ |

The chain transfer agent which can be used for producing the aforesaid oligomer includes, for example, mercapto compounds having a substituent capable of being induced into the polar group later (e.g., thioglycolic acid, thiomalic acid, thisalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoylpropionic acid, 3-[N-(2-mercaptoethyl)amino]propionic acid, N-(3-mercaptopropionyl)alanine, 2-mercaptoethanesulfonic acid, 3-mercaptopropanesulfonic acid, 4-mercaptobutanesulfonic acid, 2-mercaptoethanol, 3-mercapto-1,2-propanediol, 1-mercapto-2-propanol, 3-mercapto-2-butanol, mercaptophenol, 2-mercaptoethylamine, 2-mercaptoimidazole, and 2-mercapto-3-pyridinol), disulfide compounds which are the oxidation products of these mercapto compounds, and iodized alkyl compounds having the aforesaid polar group or substituent (e.g., iodoacetic acid, iodopropionic acid, 2-iodoethanol, 2-iodoethanolsulfonic acid, and 3-iodopropanesulfonic acid). In these compounds, the mercapto compounds are preferred.

Also, as the polymerization initiator having a specific reactive group, which can be used for the production of the aforesaid oligomer, there are, for example, 2,2'-azobis(2-cyanopropanol), 2,2'-azobis(2-cyanopentanol), 4,4'-azobis(4-cyanovaleric acid), 4,4'-azobis(4-cyanovaleric acid chloride), 2,2'-azobis[2-(5-methyl-2-imidazolin-2-yl)propane], 2,2'-azobis[2-(2-imidazolin-2-yl)propane], 2,2'-azobis[2-(2-imidazolin-2-yl)propanol], 2,2'-azobis[2-(3,4,5,6-tetrahydropyrimidin-2-yl)propane], 2,2'-azobis {2-[1-(2-hydroxyethyl-2-imidazolin-2-yl)propanol], 2,2'-azobis[2-(3,4,5,6-tetrahydropyrimidin-2-yl)propane], 2,2'-azobis{2-[1-(2-hydroxyethyl)-2-imidazolin-2-yl]propane, {2,2'-azobis[2-methyl-N-(2-hydroxyethyl)-propionamide] and the derivatives of them.

The chain transfer agent or the polymerization initiator is used in an amount of from 0.1 to 15 parts by weight, and preferably from 0.5 to 10 parts by weight per 100 parts by weight of the total monomers.

Specific examples of the macromonomer (M) for use in this invention are illustrated below, but the present invention is not limited thereto.

In the following formulae, b represents —H or —$CH_3$, d represents —H, —$CH_3$, or —$CH_2COOCH_3$, R represents —$C_nH_{2n+1}$ (wherein n represents an integer of from 1 to 18), —$CH_2C_6H_5$,

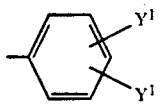

wherein $Y^1$ and $Y^2$ each represents —H, —Cl, —Br, —$CH_3$, —$COCH_3$, or —$COOCH_3$)

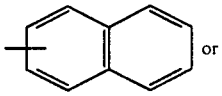

or or

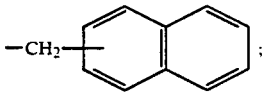

$W^1$ represents —CN, —$OCOCH_3$, —$CONH_2$, or —$C_6H_5$; $W^2$ represents —Cl, —Br, —CN, or —$OCH_3$; r represents an integer of from 2 to 18; s represents an integer of from 2 to 12; and t represents an integer of 2 to 4.

(M-1)

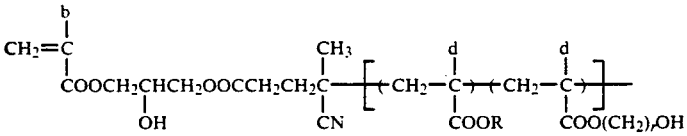

(M-2)

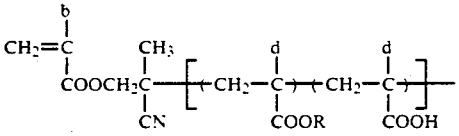

(M-3)

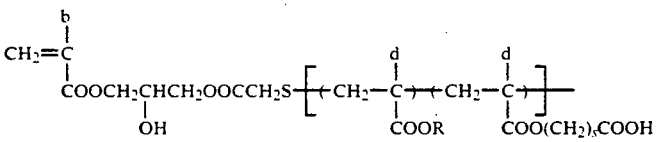

(M-4)

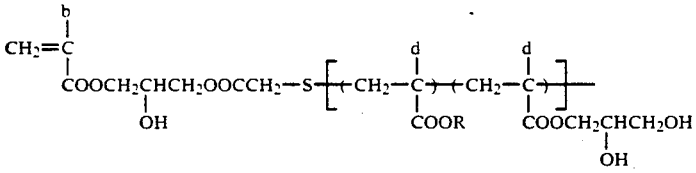

(M-5)

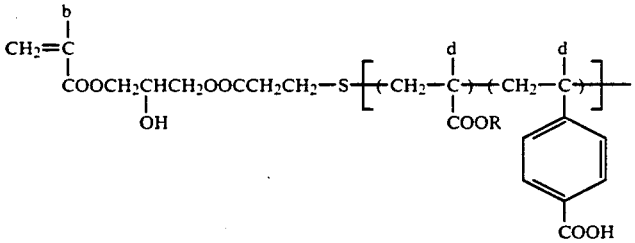

(M-6)

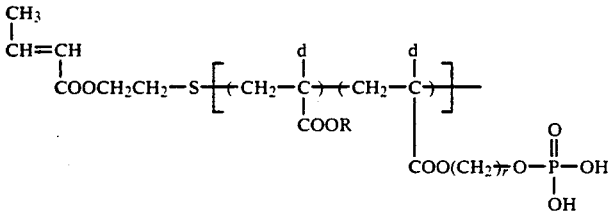

-continued
(M-7)
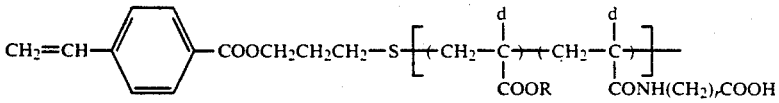
(M-8)
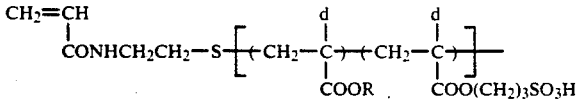
(M-9)
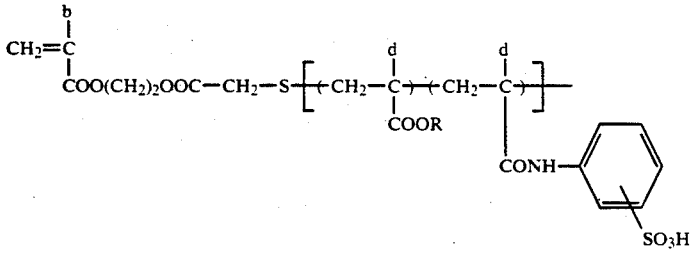
(M-10)
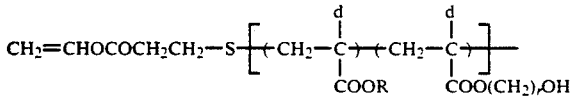
(M-11)
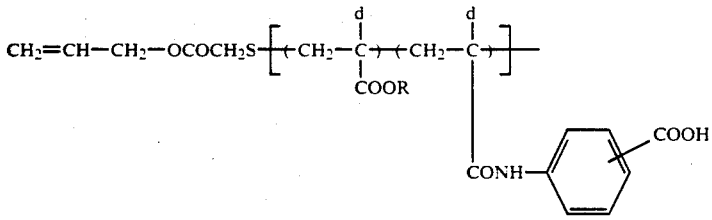
(M-12)
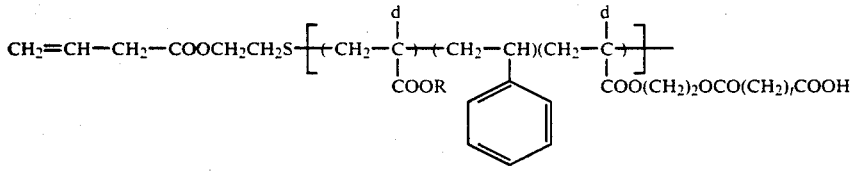
(M-13)
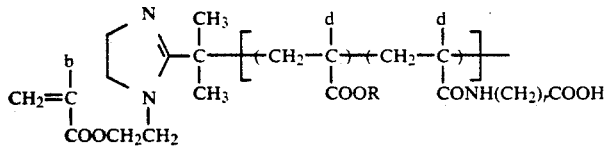
(M-14)
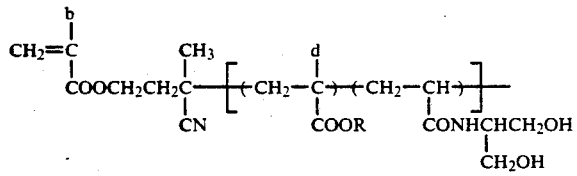
(M-15)
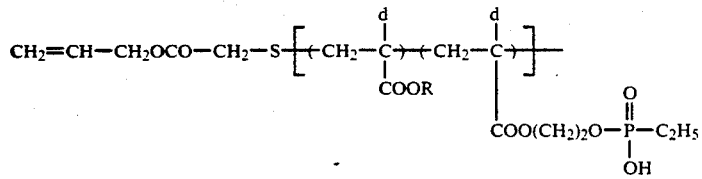

-continued
(M-16)
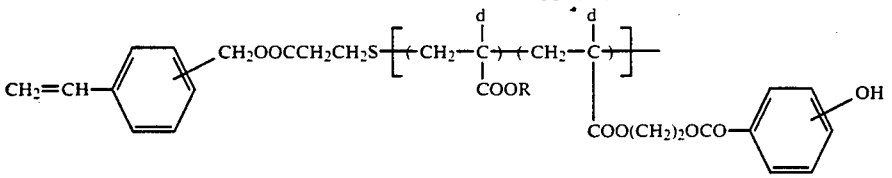
(M-17)
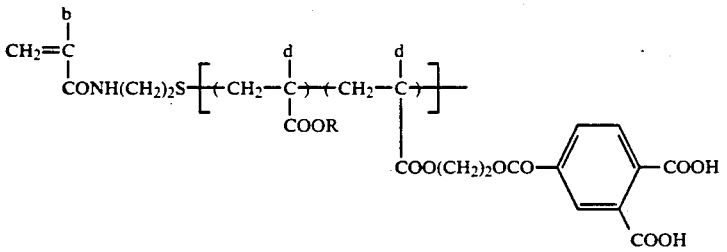
(M-18)
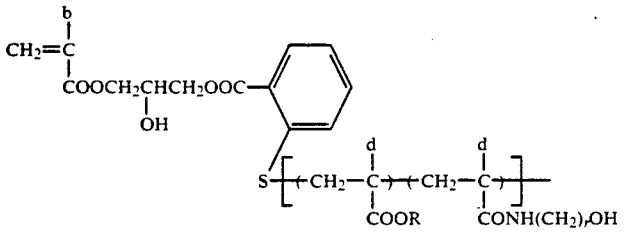
(M-19)
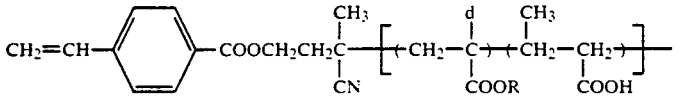
(M-20)
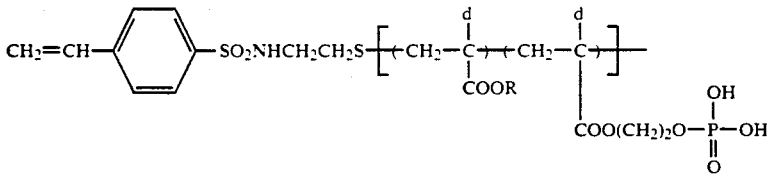
(M-21)
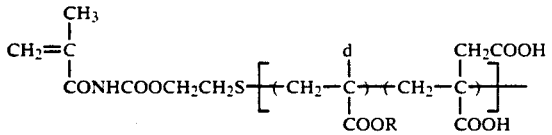
(M-22)
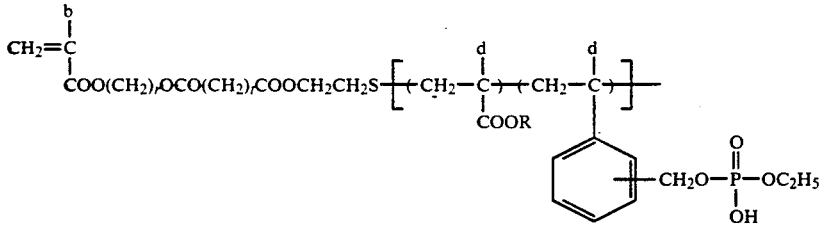
(M-23)
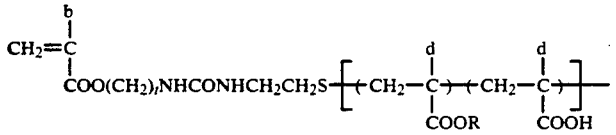
(M-24)
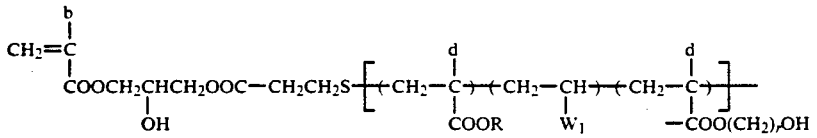

-continued

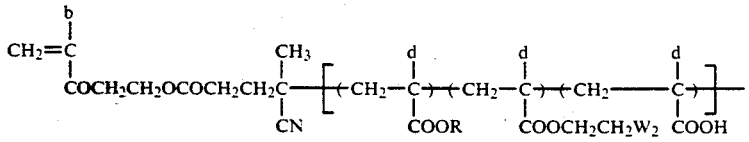

(M-25)

On the other hand, the monomer which is copolymerized with the aforesaid macromonomer (M) is shown by formula (III) described above.

In formula (III), $c^1$ and $c^2$, which may be the same or different, have the same meaning as $a^1$ and $a^2$ in formula (I) and $X^2$ and $Q^2$ have the same meaning as $X^1$ and $Q^1$ in Formula (IIa) and (IIb), respectively.

In the resin (A) for use in this invention, the composition ratio of the copolymer component composed of the macromonomer (M) as the recurring unit and the copolymer component composed of the monomer shown by formula (III) as the recurring unit is preferably from 1 to 90/99 to 10 by weight ratio, and more preferably from 5 to 60/95 to 40 by weight ratio.

Also, the resin (A) containing no copolymer component having the polar group such as $—PO_3H_2$, $—SO_3H$, —COOH, and $—PO_3R^1$ in the polymer main chain is preferred.

Furthermore, it is preferred that the resin (A) in this invention has a functional group capable of increasing the crosslinking effect of the resin (A) and a crosslinking agent and/or the resin (E). Such a functional group includes that having at least one dissociative hydrogen atom, such as —OH, —SH, $—NH_2$, $—NHR^{16}$ (wherein $R^{16}$ represents an alkyl group having from 1 to 8 carbon atoms (e.g., methyl, ethyl, propyl, butyl, and hexyl) or an aryl group (e.g., phenyl, tolyl, methoxyphenyl, and butylphenyl)), etc.,

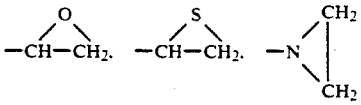

or $—CONHCH_2OR^{17}$ (wherein $R^{17}$ represents a hydrogen atom or an alkyl group having from 1 to 6 carbon atoms (e.g., methyl, ethyl, propyl, butyl, and hexyl)), a cynnamoyl group, and 3,5-di-substituted maleinimido ring groups (e.g., 3,4-dimethyl-substitution product, 3-methyl-4-ethyl-substitution product, 3,4-dichloro-substitution product, and 3,4-dibromo-substitution product).

As the copolymer component having such a functional group, any vinylic compounds having the functional group copolymerizable with the macromonomer (M) and the monomer shown by formula (III) may be used, and examples thereof are described, e.g., in *Macromonomer Data Handbook (Foundation),* edited by Kobunshi Gakkai, published by Baifukan, 1986.

Specific examples thereof are acrylic acid, α- and/or β-substituted acrylic acids (e.g., α-acetoxy compound, α-acetoxymethyl compound, α-(2-amino)methyl compound, α-chloro compound, α-bromo compound, α-fluoro compound, α-tributylsilyl compound, α-cyano compound, β-chloro compound, β-bromo compound, α-chloro-β-methyl compound and α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexanoic acid, 2-octenoic acid, 4-methyl-2-hexanoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of dicarboxylic acids at the vinyl group or allyl group, and the compounds having the functional group in the substituent of the ester derivative or amido derivative of the aforesaid carboxylic acid or sulfonic acid.

The content of the copolymer component having the functional group is from 1 to 40% by weight, and preferably from 5 to 20% by weight based on the amount of the resin (A).

Also, the resin (A) for use in this invention may contain other monomers as additional copolymer components together with the macromonomer (M), the monomer shown by formula (III), and the optional monomer having the functional group for increasing the crosslinking effect.

Examples of such an additional monomer are α-olefins, alkanoic acid vinyl or allyl esters, acrylonitrile, methacrylonitrile, vinyl ethers, acrylamide, methacrylamides, styrenes, and heterocyclic vinyls (e.g., vinylpyrrolidone, vinylpyridine, vinylimidazole, vinylthiophene, vinylimidazoline, vinylpyrazole, vinyldioxane, vinylquinoline, vinylthiazole, and vinyloxazine).

In this case, the content of the additional monomer should not exceed 20% by weight of the resin.

In the graft type copolymer (resin (A)) for use in this invention, if the content of the copolymer component corresponding to the macromonomer (M) is less than 1% by weight, the dispersion as a coating composition for a photoconductive layer becomes insufficient. Also, if the content thereof is 97% by weight or more, the copolymerization thereof with the monomer shown by formula (III) proceeds insufficiently, whereby a polymer of the monomer shown by formula (III) only or a polymer of the above-described other monomers only is undesirably formed in addition to the desired graft copolymer. Furthermore, when photoconductive particles are dispersed using the resin containing such an undesirable polymer, the polymer aggregates with the photoconductive particles.

Furthermore, the resin (A) may be a copolymer (resin(A')) having at least one acid group selected from $—PO_3H_3$, $—SO_3H$, —COOH, —OH, and

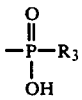

only at terminal of the main chain of the polymer containing at least one recurring unit shown by formula (III) and at least one recurring unit corresponding to the-macromonomer (M).

In the above case, —OH and

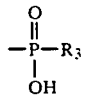

have the same meaning as —OH and

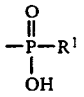

described above for the polar group-containing polymer component of resin (A). Also, the polar group has a chemical structure of bonded to one terminal of the polymer main chain directly or via an optional linkage group.

The linkage group is composed of an optional combination of an atomic group such as a carbon-carbon bond (single bond or double bond), a carbon-hetero atom bond (examples of the hetero atom are oxygen, sulfur, nitrogen, and silicon), and a hetero atom-hetero atom bond.

Specific examples thereof are linkage groups composed of a single atomic group selected from

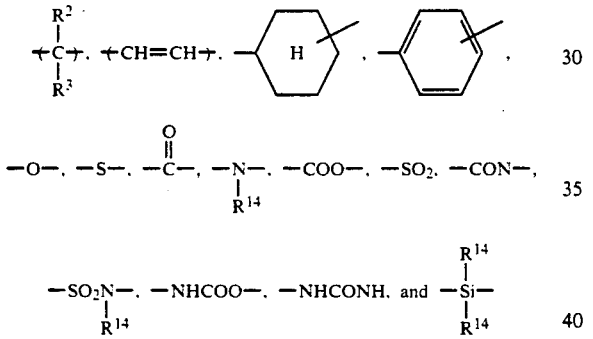

wherein $R^{12}$, $R^{13}$, and $R^{14}$ are the same as defined above) and a linkage group composed of a combination of two or more atomic groups shown above.

The resin (A') having the polar group at the terminal of the polymer main chain thereof can be obtained by using a polymerization initiator having the acid group or a specific reactive group which can be induced into the polar group in the molecule or a crosslinking agent in the polymerization reaction of at least one macromonomer (M) and the monomer shown by formula (III).

Practically, the resin (A') can be obtained in the same manner as the case of producing the oligomer having a reactive group bonded at one terminal as described above in the synthesis of the macromonomer (M).

The binder resin in this invention may contain two or more kinds of the resins (A) (including resin (A')).

The resin (E) which can be incorporated into the binder resin in this invention is a heat- and/or photocurable resin having a crosslinking functional group, i.e., a functional group of forming a crosslinkage between polymers by causing a crosslinking reaction by the action of at least one of heat and light, and, preferably, a resin which is capable of forming a crosslinked structure by reacting with the aforesaid functional group which can be contained in the resin (A).

That is, a reaction which causes bonding of molecules by a condensation reaction, an addition reaction, etc., or crosslinking by a polymerization reaction by the action of heat and/or light is utilized.

The heat-curable functional group include, practically, a group composed of at least one combination of a functional group having a dissociative hydrogen atom (e.g., —OH, —SH, and —$NHR^{21}$ (wherein $R^{21}$ represents a hydrogen atom, an aliphatic group having from 1 to 12 carbon atoms, which may be substituted, and an aryl group which may be substituted) and a functional group selected from

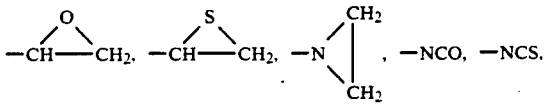

and a cyclic dicarboxylic acid anhydride; —$CONHCH_2OR^{22}$ ($R^{22}$ represents a hydrogen atom or an alkyl group having from 1 to 6 carbon atoms (e.g., methyl, ethyl, propyl, butyl, and hexyl)); and a polymerizable double bond group.

The functional group having a dissociative hydrogen atom include, preferably, —OH, —SH, and $NHR^{21}$.

Also practical examples of the polymerizable double bond group are

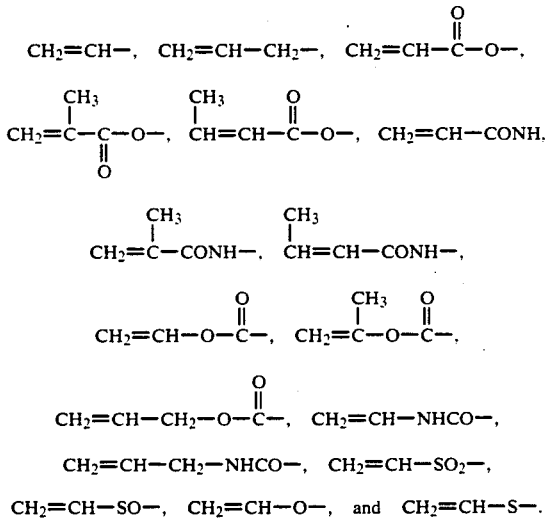

The photo-curable functional groups which can be used in this invention are described, for example, in Takahiro Tsunoda, *Kankosei Jushi (Photosensitive Resins)*, published by Insatsu Gakkai, Shuppan Bu, 1972, Mototaro Nagamatsu & Hideo Ini, *Kankoosei Kobunshi (Photosensitive Macromolecules)*, published by Kodansha, 1977, and G. A. Delgenne, *Encyclopedia of Polymer Science and Technology*, Supplement, Vol. 1, 1976.

Practical examples thereof are addition polymer groups such as an allyl ester group, a vinyl ester group, etc., and dimer groups such as a cinnamoyl group, maleimido ring group which may be substituted, etc.

Polymers and copolymers each having the aforesaid functional group are illustrated as examples of the resin (E) for use in this invention.

Practical examples of such polymers or copolymers are described in Tsuyoshi Endo, *Netsukokasei Koobunshi no Seimitsuka (making Thermo-setting Macromolecule Precise*, published by C. M. C., 1986, Yuuji Harasaki, *Newest Binder Technology Handbook*, Chapter II-1, published by Sogo Gijutsu Center, 1985, Takayuki Ootsu, *Synthesis, Planning, and New Use Development of Acryl Resins,* published by Chubu Keiei Kaihatsu Center Shuppan Bu, 1985, and Eizo Ohmori, *Functional Acrylic Resins,* published by Techno System.

Specific examples of such polymers or copolymers are polyester resins, unmodified epoxy resins, polycarbonate resins, vinyl alkanoate resins, modified polyamide resins, phenol resins, modified alkyd resins, melamine resins, acryl resins, and styrene resin and these resins may have the aforesaid functional group capable of causing a crosslinking reaction in the molecule. It is preferred that these resins do not have the polar group contained in the resin (A) or have not been modified.

Practical examples of the monomer corresponding to the copolymer component having the functional group are vinylic compounds having the functional group.

Examples thereof are described in *Macromolecular Data Handbook (foundation),* edited by Kobunshi Gakkai, published by Baifukan, 1986. Specific examples thereof are acrylic acid, α- and/or β-substituted acrylic acids (e.g., α-acetoxy compound, α-acetoxymethyl compound, α-(2-aminomethyl compound, α-chloro compound, α-bromo compound, α-fluoro compound, α-tributylsilyl compound, α-cyano compound, β-chloro compound, β-bromo compound, α-chloro-β-methoxy compound, and α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of dicarboxylic acids, and vinyl compounds having the aforesaid functional group in the substituent of the ester derivatives or amide derivatives of these carboxylic acids or sulfonic acids, or in the substituent of styrene derivatives.

More practically, a specific example of the resin (E) is a (meth)acrylic compolymer containing a monomer represented by the following formula (IV) as a copolymer component in an amount of at least 30% by weight:

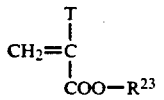

(IV)

wherein T represents a hydrogen atom, a halogen atom (e.g., chlorine and bromine), a cyano group, or an alkyl group having from 1 to 4 carbon atoms, and $R^{23}$ represents an alkyl group having from 1 to 18 carbon atoms which may be substituted (e.g., methyl, ethyl, propyl, butyl, pentyl, hexyl, octyl, decyl, dodecyl, tridecyl, tetradecyl, 2-methoxyethyl, and 2-ethoxyethyl), an alkenyl group having from 2 to 18 carbon atoms which may be substituted (e.g., vinyl, allyl, isopropenyl, butenyl, hexenyl, heptenyl, and octenyl), an aralkyl group having from 7 to 12 carbon atoms which may be substituted (e.g., benzyl, phenethyl, methoxybenzyl, ethoxybenzyl, and methylbenzyl), a cycloalkyl group having from 5 to 8 carbon atoms, which may be substituted (e.g., cyclopentyl group, cyclohexyl group, and cyclobutyl group), and an aryl group which may be substituted (e.g., phenyl, tolyl, xylyl, mesityl, naphthyl, methoxyphenyl, chlorophenyl, and dichlorophenyl).

The content of "the copolymer component having the crosslinkable (crosslinking) functional group" in the resin (E) is preferably from 0.5 to 40 mole %.

The weight average molecular weight of the resin (E) is preferably from $1\times10^3$ to $1\times10^5$, and more preferably from $5\times10^3$ to $5\times10^4$.

The compounding ratio of the resin (A') and the resin (E) depends upon the kind and particle sizes of inorganic photoconductive particles used and the surface state of the desired photoconductive layer, but the ratio of (A):(E) can be from 5 to 80:95 to 20 by weight ratio, and preferably from 10 to 50:90 to 50 by weight.

On the other hand, the crosslinking agent which can be used in this invention include, the compounds which are usually used as crosslinking agents. Practical compounds are described in Shinzo Yamashita & Tosuke Kaneko, *Crosslinking Agent Handbook,* published by Taisei Sha, 1981, and *Macromolecular Data Handbook (Foundation),* edited by Kobunshi Gakkai, published by Baifukan, 1986.

Specific examples thereof are organic silane series compounds (e.g., silane coupling agents such as vinyltrimethoxysilane, vinyltributoxysilane, γ-glycidoxypropyltrimethoxysilane, γ-mercaptopropyltriethoxysilane, and γ-aminopropyltriethoxysilane), polyisocyanate series compounds (e.g., toluylene diisocyanate, o-toluylene diisocyanate, diphenylmethane diisocyanate, triphenylmethane triisocyanate, polyethylenepolyphenyl isocyanate, hexamethylene diisocyanate, isohorone diisocyanate, and macromolecular polyisocyanate), polyol series compounds (e.g., 1,4-butanediol, polyoxypropylene glycol, polyoxyalkylene glycol, and 1,1,1-trimethylolpropane), polyamine series compounds (e.g., ethylenediamine, γ-hydroxypropylated ethylenediamine, phenylenediamine, hexamethylenediamine, N-aminoethylpiperazine, and modified aliphatic polyamines), polyepoxy group-containing compounds and epoxy resins (e.g., the compounds described in Hiroshi Kakiuchi, *New Epoxy Resin* published by Shokodo, 1985 and Kuniyuki Hashimoto, *Epoxy Resins,* published by Nikkan Kogyo Shinbun Sha, 1969), melamine resins (e.g., the compounds described in Ichiro Miwa and Hideo Matsunaga, *Urea melamine Resins,* published by Nikkan Kogyo Shinbun Sha, 1969), and poly(meth)acrylate series compounds (e.g., the compounds described in *Shin Ohgawara, Takeo Saequsa, and Toshinobu Higashimura, Oligomer,* published by Kodansha, 1976, and Eizo Ohmori, *Functional Acrylic Resins,* published by Techno System, 1985, such as, practically, polyethylene glycol diacrylate, neopentyl glycol diacrylate, 1,6-hexanediol acrylate, trimethylolpropane triacrylate, pentaerythritol polyacrylate, bisphenol A-diglycidyl ether diacrylate, oligoester acrylate, and corresponding methacrylates).

The amount of the crosslinking agent for use in this invention is from 0.5 to 30% by weight, and preferably from 1 to 10% by weight, based on the amount of the resin binder.

In this invention, the binder resin may, if necessary, contain a reaction accelerator for accelerating the crosslinking reaction of the photoconductive layer.

When the crosslinking reaction is of a reaction type for forming a chemical bond between the functional groups, organic acids (e.g., acetic acid, propionic acid, butyric acid, benzenesulfonic acid, and p-toluenesulfonic acid) can be used as the crosslinking agent.

When the crosslinking reaction is of a polymerization reaction type, polymerization initiators (e.g., peroxides and azobis series compounds, preferably azobis series polymerization initiators) or monomers having a polyfunctional polymerizable group (e.g., vinyl methacrylate, allyl methacrylate, ethylene glycol diacrylate, divinylsuccinic acid esters, divinyladipic acid esters, diallylsuccinic acid esters, 2-methylvinyl methacrylate, and divinylbenzene) can be used.

Furthermore, for the binder resin of this invention, other resin(s) can be used in addition to the resin(s) used in the present invention described above. Examples of such resins are alkyd resins, polybutyral resins, polyolefins, ethylene-vinyl acetate copolymers, styrene resins, styrene-butadiene resins, acrylatebutadiene resins, and vinyl alkanoate resins.

The content of aforesaid other resin should not exceed 30% by weight of the total resins for the binder resins and, if the content is 30% by weight or more, the effect of this invention (in particular, the improvement of electrostatic characteristics) cannot be obtained.

The coating composition containing the binder resin in this invention for forming a photoconductive layer is coated on a support and is crosslinked or subjected to thermosetting. For performing crosslinking or thermosetting, a severer drying condition than that used for producing conventional electrophotographic light-sensitive materials is employed. For example, the drying step is carried out at a higher temperature and/or for a longer time. Also, after evaporating off the solvent in the coating composition by drying, the photoconductive layer may be further subjected to a heat treatment, for example, at from 60° to 120° C. for from 5 to 120 minutes. In the case of using the aforesaid reaction accelerator, a milder drying condition can be employed.

Although the crosslinking is preferably caused between the aforesaid resins used in the present invention, it may be caused between the resin used in the present invention and other resins. It is particularly preferred that the resin used in this invention is crosslinked with a resin having a weight average molecular weight of at least $2\times10^4$.

It sometimes desired that the electrophotographic light-sensitive material of this invention has a higher mechanical strength while retaining the excellent electrophotographic characteristics. For this purpose, a method of introducing a heat- and/or photo-curable functional group into the main chain of the resin (A) (graft type copolymer) can be applied.

That is, in this invention, it is preferred that the resin (A) for use in this invention contains at least one monomer having a heat- and/or photo-curable functional group as a copolymer component in addition of the aforesaid macromonomer (M) and the monomer shown by formula (III). By crosslinking the polymers with such a heat- and/or photo-curable functional group, the interaction between the polymers is increased thereby results in the improved strength of the layer formed. Thus, the resin for use in this invention containing such a heat- and/or photo-curable functional group increases the interaction between the binder resins without hindering the suitable adsorption and covering effect of the binder resins on the surface of the photoconductive particles, which results in improving the film strength of the photoconductive layer.

The term "heat-curable and/or photo-curable functional group" as used in this invention means a functional group capable of curing a resin by the action of at least one of heat and light.

The heat-curable functional group (functional group performing a thermosetting reaction) in this invention is described in Tsuyoshi Endo, *Netsu Kokasei Koobunshi no Seimitsuka (Making Thermosetting Macromolecules Precise)*, published by C. M. C., 1986, Yuji Harasaki, *Newest Binder Technology Handbook, Chapter II-1*, published by Sogo Gijutsu Center, 1985, Takayuki Ootsu, *Synthesis, Planning, and New Use Development of Acrylic Resins*, published by Chubu Keiei Kaihatsu Center Shuppanbu, 1985, Eizo Ohmori, *Functional Acrylic Resins*, published by Techno System, 1985, etc.

Examples of the functional group are —OH, —SH, $—NH_2$, $—NHR^{16}$ (wherein $R^{16}$ represents a hydrocarbon group such as, practically those shown above on $R^{11}$ in formula (I)),

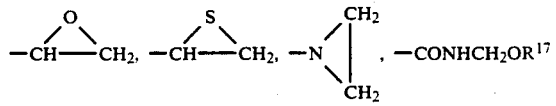

(wherein $R^{17}$ represents a hydrogen atom or an alkyl group having from 1 to 8 carbon atom (e.g., methyl, ethyl, propyl, butyl, hexyl, and octyl)), —N=C=O, or

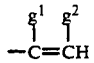

(wherein $g^1$ and $g^2$ each represents a hydrogen atom, a halogen atom (e.g., chlorine and bromine), or an alkyl group having from 1 to 4 carbon atoms (e.g., methyl and ethyl)).

Also, practical examples of the polymerizable double bond group are

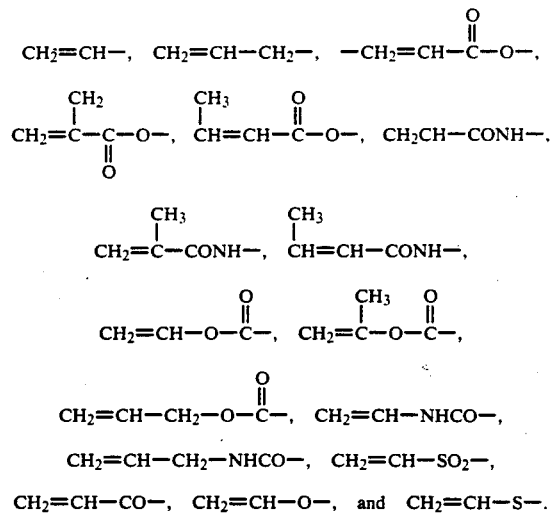

The "photo-curable functional group" for use in this invention are described in Takahiro Tsunoda, *Kankoosei Jushi (Photosensitive Resins)*, published by Insatsu Gakkai Shuppanbu, 1972, Mototaro Nagamatsu & Hideo Inui, *Kankosei Kobunshi (Photosensitive Macromolecules)*, published by Kodansha, 1977, and G. A. Delgenne, *Encylopedia of Polymer Science and Technology, Supplement*, Vol. 1, 1976.

Practical examples thereof are addition polymer groups such as an allyl ester group, vinyl ester group, etc., and dimerizing groups such as a cinnamoyl group, a maleimido ring group which may be substituted.

The resin having the heat- and/or photo-curable functional group can be synthesized by using monomer having the heat- and/or photo-curable functional group as a copolymer component.

When the resin for use in this invention has the heat- and/or photo-curable functional group, a reaction accelerator may be added, if necessary, to the resin for accelerating the crosslinking reaction of the resin in the photoconductive layer.

In the reaction type of forming a chemical bond between the functional groups, organic acids (e.g., acetic acid, propionic acid, butyric acid, benzenesulfonic acid, p-toluenesulfonic acid), crosslinking agents, etc., are used.

Practical examples of the crosslinking agent are described in Shinzo Yamashita and Tohsuke Kaneko, *Crosslinking Agent Handbood,* published by Taisei Sha, 1981. Specific examples are crosslinking agents such as organic silanes which are ordinary used as crosslinking agents, polyurethane, polyisocyanate, etc., and curing agents such as epoxy resins, melamine resins, etc.

In the case of a polymerizing reaction, polymerization initiators (e.g., peroxides and azobis series compounds, preferably azobis series polymerization initiators) and monomers having a polyfunctional polymerizable group (e.g., vinyl methacrylate, allyl methacrylate, ethylene glycol diacrylate, polyethylene glycol acrylate, divinylsuccinic acid ester, divinyladipic acid ester, diallylsuccinic acid ester, 2-methylvinyl methacrylate, and divinylbenzene) are used.

Also, when the resin having such a heat-curable functional group is used in this invention, a heat-curing treatment is applied. The heat-curing treatment can be carried out by making the drying condition used in the production of the light-sensitive material severer than a conventional drying condition. For example, the photoconductive layer formed may be dried for a period of from 5 minutes to 120 minutes at from 60° C. to 120° C. In this case, when the aforesaid reaction accelerator is used, a milder condition can be employed.

In this invention, when the binder resin contains at least one of the low molecular weight resins (AL) and (AL') each having a weight average molecular weight of from $1\times10^3$ to $2\times10^4$ and at least one of the high molecular weight resins (B), (C), and (D) each having a weight average molecular weight of from $5\times10^4$ to $5\times10^5$ described above, the mechanical strength of the electrophotographic light-sensitive material is further improved.

The use of the resin (B), (C), or (D) sufficiently increases the mechanical strength of the photoconductive layer when the mechanical strength of the photoconductive layer is insufficient by the use of the resin (A) only.

Also, in the electrophotographic light-sensitive material of this invention using the low molecular resin (AL) and one of the high molecular weight resins (B), (C) and (D) together, the smoothness of the surface of the photoconductive layer is good in the case of using as an electrophotographic lithographic printing master plate. Also, since photoconductive particles such as zinc oxide particles are sufficiently dispersed in the binder resin, when the photoconductive layer is subjected to a desensitizing treatment with a de-sensitizing solution after imagewise exposure and processing, the non-image portions are sufficiently and uniformly rendered hydrophilic and adhesion of a printing ink to the non-image portions at printing is inhibited, whereby no background staining occurs even by printing 10,000 prints.

That is, in this invention, when the resin (AL) and one of the resins (B) to (D) are used together, the binder resin is suitably adsorbed onto inorganic photoconductive particles and suitably coats the particles, whereby the film strength of the photoconductive layer is sufficiently maintained.

In the resin (AL), the content of the macromonomer shown by the formula (I) to (IV) described above is from 40 to 70% by weight per 100 parts by weight of the resin (AL). Also, the weight average molecular weight of the resin (AL) is preferably from $1\times10^3$ to $1.5\times10^4$ and more preferably from $3\times10^3$ to $1.0\times10^4$.

Furthermore, in the resin (AL'), the content of the polar group bonded to the terminal of the main chain of the copolymer is preferably from 0.5% by weight to 10% by weight per 100 parts by weight of the resin (AL'). The weight average molecular weight of the resin (AL') and the content of the recurring unit corresponding to the macromonomer in the resin (AL') are the same as those in the resin (AL) described above.

Then, the use of a combination of the low molecular weight resin (AL) and/or the low molecular weight resin (AL') having at least one of the aforesaid acid groups at the terminal of the main chain of the copolymer and the high molecular weight resin (B) having neither polar group nor basic group contained in the binder resin (A) of in this invention is explained in detail.

The resin (B) which can be used in this invention is the resin having a weight average molecular weight of from $5\times10^4$ to $5\times10^5$ and having neither the aforesaid polar group (i.e., the acid group such as COOH or OH at the terminal of the grafted portion and the acid group at the terminal of the main chain in the resin (A)) nor a basic group at the terminal of the grafted portion and the terminal of the main chain of the copolymer. The weight average molecular weight of the resin (B) is preferably from $8\times10^4$ to $3\times10^5$.

The glass transition point of the resin (B) is in the range of preferably from 0° C. to 120° C., and more preferably from 10° C. to 80° C.

Any resins (B) which are conventionally used as a binder resin for electrophotographic light-sensitive materials can be used in this invention alone or as a combination thereof. Examples of these resins are described in Harumi Miyahara and Hidehiko Takei, *Imaging,* Nos. 8 and 9 to 12, 1978 and Ryuji Kurita and Jiro Ishiwata, *Kobunshi (Macromolecule),* 17, 278–284 (1968).

Specific examples of the resin (B) are an olefin polymer, an olefin copolymer, a vinyl chloride copolymer, a vinylidene chloride copolymer, a vinyl alkanoate polymer, a vinyl alkanoate copolymer, an allyl alkanoate polymer, an allyl alkanoate copolymer, styrene, a styrene derivative, a styrene polymer, a styrene copolymer a butadiene-styrene copolymer, an isoprenestyrene copolymer, a butadiene-unsaturated carboxylic acid ester copolymer an acrylonitrile copolymer, a methacrylonitrile copolymer, an alkyl vinyl ether copolymer an acrylic acid ester polymer, an acrylic acid ester copolymer, a methacrylic acid ester polymer, a methacrylic acid copolymer, a styrene-acrylic acid ester copolymer, a styrene-methacrylic acid ester copolymer, an itaconic acid diester polymer, an itaconic acid diester copolymer, a maleic anhydride copolymer, an acrylamide copolymer, a methacrylamide copolymer, a hydroxy group-modified silicone resin, a polycarbonate resin, a ketone resin, an amide resin, a hydroxy group- or carboxy group-modified polyester resin, a butyral resin, a polyvinyl acetal resin, a cyclized rubber-methacrylic acid ester copolymer, a cyclized rubber-acrylic acid ester copolymer, a copolymer having a heterocyclic group containing no nitrogen atom (examples of the heterocyclic ring are furan, tetrahydrofuran, thiophene, dioxane, dioxolan, lactone, benzofuran, benzothiophene, and 1,3-dioxetane), and an epoxy resin.

More practically, as the resin (B), there are, for example, (meth)acrylic copolymers or polymers each containing at least one monomer shown by following formula (IV) as a (co)polymer component in a total amount of at least 30% by weight;

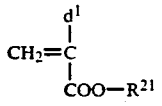

(IV)

wherein $d^1$ represents a hydrogen atom, a halogen atom (e.g., chlorine and bromine), a cyano group, or an alkyl group having from 1 to 4 carbon atoms, and is preferably an alkyl group having from 1 to 4 carbon atoms and $R^{21}$ represents an alkyl group having from 1 to 18 carbon atoms which may be substituted (e.g., methyl, ethyl, propyl, butyl, pentyl, hexyl, octyl, decyl, dodecyl, tridecyl, tetradecyl, 2-methoxyethyl, and 2-ethoxyethyl), an alkenyl group having from 2 to 18 carbon atoms, which may be substituted (e.g., vinyl, allyl, isopropenyl, butenyl, hexenyl, heptenyl, and octenyl), an aralkyl group having from 7 to 14 carbon atoms which may be substituted (e.g., benzyl, phenethyl, methoxybenzyl, ethoxybenzyl, and methylbenzyl), a cycloalkyl group having from 5 to 8 carbon atoms which may be substituted (e.g., cyclopentyl, cyclohexyl, and cycloheptyl), or an aryl group (e.g., phenyl, tolyl, xylyl, mesityl, naphthyl, methoxyphenyl, ethoxyphenyl, chlorophenyl, and dichlorophenyl).

In formula (IV), $R^{21}$ represents preferably an alkyl group having from 1 to 4 carbon atoms, an aralkyl group having from 7 to 14 carbon atoms which may be substituted (particularly preferred aralkyl includes benzyl, phenethyl, naphthylmethyl, and 2-naphthylethyl, each of which may be substituted), or a phenethyl group or a naphthyl group which may be substituted (examples of the substituent are chlorine, bromine, methyl, ethyl, propyl, acetyl, methoxycarbonyl, and ethoxycarbonyl, and the phenethyl group or naphthyl group may have 2 or 3 substituents).

Furthermore, in the resin (B), a component which is copolymerized with the aforesaid (meth)acrylic acid ester may be a monomer other than the monomer shown by formula (VI), and examples of the monomer are α-olefins, alkanoic acid vinyl esters, alkanoic acid allyl esters, acrylonitrile, methacrylonitrile, vinyl ethers, acrylamides, methacrylamides, styrenes, and heterocyclic vinyls (e.g., 5- to 7-membered heterocyclic rings having from 1 to 3 non-metallic atoms other than nitrogen atom (e.g., oxygen and sulfur) and practical examples are vinylthiophene, vinyldioxane, and vinylfuran).

Preferred examples of the monomer are alkanoic acid vinyl esters or alkanoic acid allyl esters each having from 1 to 3 carbon atoms, acrylonitrile, methacrylonitrile and styrene derivatives (e.g., vinyltoluene, butylstyrene, methoxystyrene, chlorostyrene, dichlorostyrene, bromostyrene, and ethoxystyrene).

On the other hand, the resin (B) for use in this invention does not contain a basic group, and examples of such basic groups include are an amino group and a nitrogen atom-having heterocyclic group, which may have a substituent.

Then, the use of a combination of the aforesaid low molecular weight resin (AL) and/or (AL') and the high molecular weight resin (C) having at least one of —OH and a basic group is described hereinafter in detail.

In the resin (C), the content of the copolymer component containing —OH and/or a basic group is from 0.05 to 15% by weight, and preferably from 0.5 to 10% by weight of the resin (C). The weight average molecular weight of the resin (C) is from $5\times10^4$ to $5\times10^5$, and preferably from $8\times10^4$ to $1\times10^5$. The glass transition point of the resin (C) is in the range of preferably from 0° C. to 120° C., and preferably from 10° C. to 80° C.

In this invention, it is considered that the OH component or the basic group component in the resin (C) has a weak interaction with the interface with the photoconductive particles and the resin (AL) or (AL') to stabilize the dispersion of the photoconductive particles and improve the film strength of the photoconductive layer after being formed. However, if the content of the OH or basic group component in the resin (C) exceeds 15% by weight, the photoconductive layer formed tends to be influenced by moisture, and thus the moisture resistance of the photoconductive layer tend to decrease. However, as long as the resin (C) has the aforesaid properties, any conventionally known resins having such properties can be used in the present invention, as described for the resin (B).

Practically, the aforesaid (meth)acrylic copolymers each containing the monomer shown by formula (VI) describe above in a proportion of at least 30% by weight as the copolymer component can be used as the resin (C).

As "the copolymer component containing —OH and/or a basic group" contained in the resin (C), any vinylic compounds each having the substituent (i.e., —OH and/or the basic group) copolymerizable with the monomer shown by aforesaid formula (VI) can be used.

The aforesaid basic group in the resin (C) include, for example, an amino group represented by the following formula (V) and a nitrogen-containing heterocyclic group:

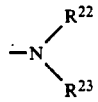

(V)

wherein $R^{22}$ and $R^{23}$, which may be the same or different, each represents a hydrogen atom, an alkyl group which may be substituted (e.g., methyl, ethyl, propyl, butyl, hexyl, octyl, decyl, dodecyl, tertadecyl, octadecyl, 2-bromoethyl, 2-chloroethyl, 2-hydroxyethyl, and 3-ethoxypropyl), an alkenyl group which may be substituted (e.g., allyl, isopropenyl and 4-butynyl), an aralkyl group which may be substituted (e.g., benzyl, phenethyl, chlorobenzyl, methylbenzyl, methoxybenzyl, and hydroxybenzyl), an alicyclic group (e.g., cyclopentyl and cyclohexyl), or an aryl group (e.g., phenyl, tolyl, xylyl, mesityl, butylphenyl, methoxyphenyl, and chlorophenyl). Furthermore, $R^{22}$ and $R^{23}$ each may be bonded by a hydrocarbon group through, if desired, a hetero atom.

The nitrogen-containing heterocyclic ring as the basic group in the resin (C) includes, for example, 5- to 7-membered heterocyclic rings each containing from 1 to 3 nitrogen atoms, and the heterocyclic ring may further contain a condensed ring with a benzene ring, a naphthalene ring, etc. These heterocyclic rings may have a substituent.

Specific examples of the heterocyclic ring are pyrrole, imidazole, pyrazole, pyridine, piperazine, pyrimidine, pyridazine, indolizine, indole, 2H-pyrrole, 3H-indole, indazole, purine, morpholine, isoquinoline, phthalazine, naphthyridine, quinoxaline, acridine, phenanthridine, phenazine, pyrrolidine, pyrroline, imidazolidine, imidazoline, pyrazoline, piperidine, piperazine, quinacridine, indoline, 3,3-dimethylindolenine, 3,3-dimethylnaphthindolenine, thiazole, benzothiazole, naphthothiazole, oxazole, benzoxazole, naphthoxazole, selenazole, benzoselenazole, naphthoselenazole, oxazoline, isooxazoline, benzoxazole, morpholine, pyrrolidone, triazole, benzotriazole, and triazine rings.

The aforesaid copolymer component or monomer having —OH and/or the basic group is obtained by incorporating —OH and/or the basic group into the substituent of an ester derivative or amide derivative induced from a carboxylic acid or sulfonic acid having a vinyl group as described in *Kobunshi (Macromolecular) Data Handbook (Foundation)*, edited by Kobunshi Gakkai, published by Baifukan, 1986.

Specific examples of such a monomer (copolymer component) are 2-hydroxyethyl methacrylate, 3-hydroxypropyl methacrylate, 3-hydroxy-2-chloromethacrylate, 4-hydroxybutyl methacrylate, 6-hydroxyhexyl methacrylate, 10-hydroxydecyl methacrylate, N-(2-hydroxyethyl)acrylamide, N-(3-hydroxypropyl)-methacrylamide, N-($\alpha$,$\beta$-dihydroxymethyl)ethylmethacrylamide, N-(4-hydroxybutyl)methacrylamide, N,N-dimethylaminoethyl methacrylate, 2-(N,N-diethylaminoethyl) methacrylate, 3-(N,N-dimethylpropyl) methacrylate, 2-(N,N-dimethylethyl)methacrylamide, hydroxystyrene, hydroxymethylstyrene, N,N-dimethylaminomethylstyrene, N,N-diethylaminomethylstyrene, N-butyl-N-methylaminomethylstyrene, and N-(hydroxyphenyl)methacrylamide.

Examples of the vinyl compound having a nitrogen-containing heterocyclic ring are described in the aforesaid *Macromolecular Data Handbook (Foundation)*, pages 175 to 181, D. A. Tomalia, *Reactive Heterocyclic Monomers*, Chapter 1 of Functional Monomers, Vol. 2, Marcel DeRRer Inc., N.Y., 1974, and L. S. LusRin, *Basic Monomers*, Chapter 3 of *Functional Monomers*, Vol. 2, Marcel DeRRer Inc., N.Y., 1974.

Furthermore, the resin (C) may contain monomer(s) other than the aforesaid monomer having —OH and/or the basic group in addition to the latter monomer as a copolymer component. Examples of such a monomer are those described above for the monomers which can be used as other copolymer components for the resin (B).

Then, the use of a combination of the aforesaid low molecular weight resin (AL) and/or (AL') and the high molecular weight resin (D) having an acid group as the side chain of the copolymer component at a content of less than 50%, and preferably less than 30% of the content of the acid group contained in the resin (AL') or an acid group having a pKa value larger than that of the acid group contained in the resin (AL') as the side chain of the copolymer component is described in detail.

The weight average molecular weight of the resin (D) is from $5\times10^4$ to $5\times10^5$, and preferably from $7\times10^4$ to $4\times10^5$.

The acid group contained at the side chain of the copolymer in the resin (D) is preferably contained in the resin (D) at a proportion of from 0.05 to 3% by weight and more preferably from 0.1 to 1.5% by weight. Also, it is preferred that the polar group is incorporated in the resin (D) in a combination with the acid group in the resin (AL') shown in Table A below.

TABLE A

| Acid Group in Resin (AL') | Acid Group in Resin (D) |
|---|---|
| $-SO_3H$ and/or $-PO_3H_2$ | $-COOH$ |
| $-SO_3H$. $-PO_3H_2$ and/or $-COOH$ | $-\overset{\overset{O}{\|}}{\underset{\underset{OH}{\|}}{P}}-OR^o$ |

The glass transition point of the resin (D) is in the range of preferably from 0° C. to 120° C., more preferably from 0° C. to 100° C., and most preferably from 10° C. to 80° C.

The resin (D) shows a very weak interaction for photoconductive particles as compared to the resin (AL) and/or (AL'), has a function of mildly coating the particles, and sufficiently increases the mechanical strength of the photoconductive layer, without reducing the function of the resin (AL) or (AL'), when the strength thereof is insufficient by the resin (AL) or (AL') alone.

If the content of the polar group at the side chain of the resin (D) exceeds 3% by weight, the adsorption of the resin (D) onto photoconductive particles occurs to destroy the dispersion of the photoconductive particles and to form aggregates or precipitates, which results in causing a state of not forming coated layer or greatly reducing the electrostatic characteristics of the photoconductive particles even if the coated layer is formed. Also, in such a case, the surface property of the photoconductive layer is roughened to reduce the strength to mechanical friction.

Practical examples of $R^3$ in $$-\overset{\overset{O}{\|}}{\underset{\underset{OH}{\|}}{P}}-OR^3$$

in the resin (D) are an alkyl group having from 1 to 12 carbon atoms which may be substituted (e.g., methyl, ethyl, propyl, butyl, hexyl, octyl, decyl, dodecyl, 2-chloroethyl, 2-methoxyethyl, 2-ethoxyethyl, and 3-methoxypropyl), an aralkyl group having from 7 to 12 carbon atoms which may be substituted (e.g., benzyl, phenethyl, chlorobenzyl, methoxybenzyl, and methylbenzyl), an alicyclic group having from 5 to 8 carbon atoms which may be substituted (e.g., cyclopentyl and cyclohexyl), and an aryl group which may be substituted (e.g., phenyl, tolyl, xylyl, mesityl, naphthyl, chlorophenyl, and methoxyphenyl).

As the resin (D), any conventional known resins can be used in this invention as long as they have the aforesaid properties and, for example, the conventionally known resins described above for the resin (B) can be used.

More specifically, examples of the resin (D) are (meth)acrylic copolymers each containing the aforesaid monomer shown by formula (IV) described above as the copolymer component in a proportion of at least 30% by weight of the copolymer.

Also, as "the copolymer component having an acid group" in the resin (D) for use in this invention, any acid group-containing vinyl compounds copolymerizable with the monomer shown by the aforesaid formula (IV) can be used. For example, such vinyl compounds are described in *Macromolecular Data Handbook (Foundation)*, edited by Kobunshi Gakkai, 1986. Specific examples of the vinyl compound are acrylic acid, α- and/or β-substituted acrylic acid (e.g., α-acetoxy compound, α-acetoxymethyl compound, α-(2-amino)-methyl compound, α-chloro compound, α-bromo compound, α-fluoro compound, α-tributylsyrlyl compound, α-cyano compound, β-chloro compound, β-bromo compound, α-chloro-β-methoxy compound, α,β-dichloro compound), methacrylic acid, itaconic acid, itaconic acid half esters, itaconic acid half amides, crotonic acid, 2-hexanoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of dicarboxylic acids, and ester derivatives or amide derivatives of these carboxylic acids or sulfonic acids having the acid group in the substituent thereof.

Specific examples of these compounds include the compounds (A-1) to (A-41) which are described above as the polar group-having compound at the grafted portion in the aforesaid macromonomer (M).

Furthermore, the resin (D) for use in this invention may further contain other components together with the aforesaid monomer shown by formula (IV) and the aforesaid monomer having an acid group as other copolymer components. Specific examples of such monomers are those illustrated above as the monomers which can be contained in the resin (B) as other copolymer components.

Moreover, the binder resin for use in this invention may further contain other resin(s) in addition to the resin (AL) or (AL') and the resin (B), (C) or (D). Examples of other resins are alkyd resins, polybutyral resins, polyolefins, ethylene-vinyl acetate copolymers, styrene resins, styrene-butadiene resins, acrylate-butadiene resins, and vinyl alkanoate resins.

However, the content of these other resin(s) should be less than about 30% by weight of the resins (AL) or (AL') and (B), (C) or (D) since, if the content exceeds about 30% the effect (in particular, the improvement of electrostatic characteristics) of this invention cannot be obtained.

The compounding ratio of the resin (AL) or (AL') to the resin (B), (C), or (D) differs depending upon the type of an inorganic photoconductor to be used, the particle sizes of the photoconductive particles, and the surface state thereof, but is generally 5 to 80/95 to 20 by weight, and preferably 15 to 60/85 to 40 by weight.

The ratio of the weight average molecular weight of the resin (B), (C), or (D) to that of the resin (AL), (AL') is preferably at least 1.2, and more preferably at least 2.0.

As the inorganic photoconductor for use in this invention, there are zinc oxide, titanium oxide, zinc sulfide, cadmium sulfide, cadmium carbonate, zinc selenide, cadmium selenide, tellurium selenide, lead sulfide, etc.

The total proportion of the binder resins for the photoconductive layer in this invention is from 10 to 100 parts by weight, and preferably from 15 to 50 parts by weight of the photoconductor.

In this invention, various kinds of dyes can be used, if necessary, for the photoconductive layers as spectral sensitizers. Examples of these dyes are carbonium series dyes, diphenylmethane dyes, triphenylmethane dyes, xanthene series dyes, phthalein series dyes, polymethine dyes (e.g., oxonol dyes, merocyanine dyes, cyanine dyes, rhodacyanine dyes, and styryl dyes), and phthalocyanine dyes (inclusive of metallized dyes) described in Harumi Miyamoto and Hidehiko Takei, *Imaging*, 1973, (No. 8), page 12, C. J. Young,, et al, *RCA Review*, 15, 469 (1954), Koohei Kiyoda, *Journal of Electric Communication Society of Japan, J 63 C (No. 2)*, 97 (1980), Yuuji Harasaki et al, *Kogyo Kagaku Zasshi*, 66, 78 and 188 (1963), and Tadaaki Tani, *Journal of the Society of Photographic Science and Technology of Japan*, 35, 208 (1972).

Specific examples of suitable carbonium series dyes, triphenylmethane dyes, xanthene series dyes, and phthalein series dyes are described in JP-B-51-452, JP-A-50-90334, JP-A-50-114227, JP-A-53-39310, JP-A-53-82353, and JP-A-57-16455, and U.S. Pat. Nos. 3,052,540 and 4,054,450.

Also, suitable oxonol dyes, merocyanine dyes, cyanine dyes, and rhodacyanine dyes are more practically described in U.S. Pat. Nos. 3,047,384, 3,110,591, 3,212,008, 3,125,447, 3,128,179, 3,132,942, and 3,622,317, British Patents 1,226,892, 1,309,274, and 1,405,898, and JP-B-48-7814 and JP-B-55-18892.

Furthermore, polymethine dyes capable of spectrally sensitizing in the wavelength region of from near infrared to infrared longer than 700 nm are described in JP-B-51-41061, JP-A-47-840, JP-A-47-44180, JP-A-49-5034, JP-A-49-45122, JP-A-57-46245, JP-A-56-35141, JP-A-57-157254, JP-A-61-26044, and JP-A-61-27551, U.S. Pat. Nos. 3,619,154 and 4,175,956, and *Research Disclosure*, 216, 117 to 118 (1982).

The light-sensitive material of this invention is excellent in that even when various sensitizing dyes are used for the photoconductive layer, the performance thereof is reluctant to vary by such sensitizing dyes.

If desired, the photoconductive layers may further contain various additives commonly employed in electrophotographic photoconductive layers, such as chemical sensitizers. Examples of such additives are electron-acceptive compounds (e.g., halogen, benzoquinone, chloranil, acid anhydrides, and organic carboxylic acids) described in *Imaging*, 1973, (No. 8), page 12, and polyarylalkane compounds, hindered phenol compounds, and p-phenylenediamine compounds described in Hiroshi Kokado, *Recent Photoconductive Materials and Development and Practical Use of Light-sensitive Materials*, Chapters 4 to 6, published by Nippon Kagaku Joho K. K., 1986.

There is no particular restriction on the amount of these additives, but the amount thereof is usually from 0.0001 to 2.0 parts by weight per 100 parts by weight of the photoconductive material.

The thickness of the photoconductive layer is from 1 μm to 100 μm, and preferably from 10 μm to 50 μm.

Also, when the photoconductive layer is used as a charge generating layer of a double layer type electrophotographic light-sensitive material having the charge generating layer and a charge transporting layer, the thickness of the charge generating layer is from 0.01 μm to 1 μm, and preferably from 0.05 μm to 0.5 μm.

As the case may be, an insulating layer is formed on the photoconductive layer for the protection of the photoconductive layer and the improvement of the durability and the dark decay characteristics of the photoconductive layer. In this case, the thickness of the insulating layer is relatively thin but, when the light-sensitive material is used for a specific electrophotographic process, the insulating layer having a relatively thick thickness is formed.

In the latter case, the thickness of the insulating layer is from 5 μm to 70 μm, and particularly from 10 μm to 50 μm.

As the charge transporting material for the double layer type light-sensitive material, there are polyvinylcarbazole, oxazole series dyes, pyrazoline series dyes, and triphenylmethane series dyes. The thickness of the charge transporting layer is from 5 μm to 40 μm, and preferably from 10 μm to 30 μm.

Resins which can be used for the insulating layer and the charge transporting layer typically include thermoplastic and thermosetting resins such as polystyrene resins, polyester resins, cellulose resins, polyether resins, vinyl chloride resins, vinyl acetate resins, vinyl chloride-vinyl acetate copolymer resins, polyacryl resins, polyolefin resins, urethane resins, epoxy resins, melamine resins, and silicone resins.

The photoconductive layer in this invention can be formed on a conventional support. In general, the support for the electrophotographic light-sensitive material is preferably electroconductive. As the conductive support, there are base materials such as metals, papers, plastic sheets, etc., rendered electroconductive by the impregnation of a low resisting material, the base materials the back surface of which (the surface opposite to the surface of forming a photoconductive layer) is rendered electroconductive and having coated with one or more layer for preventing the occurrence of curling of the support, the aforesaid support having formed on the surface a water resisting adhesive layer, the aforesaid layer having formed on the surface at least one precoat, and a support formed by laminating thereon a plastic film rendered electroconductive by vapor depositing thereon an aluminum, etc.

Practical examples of electroconductive base materials and conductivity-imparting materials are described in Yukio Sakamoto, *Denshi Shashin (Electrophotography)*, 14 (No. 1), 2 to 11 (1975), Hiroyuki Moriga, *Chemistry of Specific Papers*, published by Koobunshi Kankoo Kai, 1975, M. F. Hoover, *J. Macromol. Sci. Chem.*, A to 4 (6), 1327–1417 (1970).

The following examples are intended to illustrate the present invention, but the present invention is not limited thereto.

PRODUCTION EXAMPLE 1 OR MACROMONOMER: MM-1

A mixture of 90 g of ethyl methacrylate, 10 g of 2-hydroxyethyl methacrylate, 5 g of thioglycolic acid and 200 g of toluene was heated to 75° C. with stirring under nitrogen gas stream and, after adding thereto 1.0 g of 2,2-azobisisobutyronitrile (A.I.B.N.), the reaction was carried out for 8 hours. Then, to the reaction mixture were added 8 g of glycidyl methacrylate, 1.0 g of N,N-dimethyldodecylamine and 0.5 g of t-butylhydroquninone, and the resulting mixture was stirred for 12 hours at 100° C. After cooling, the reaction mixture was reprecipitated from 2 liters of n-hexane to obtain 82 g of the desired macromonomer (MM-1) as a white powder. The weight average molecular weight of the macromonomer obtained was $3.8\times10^3$.

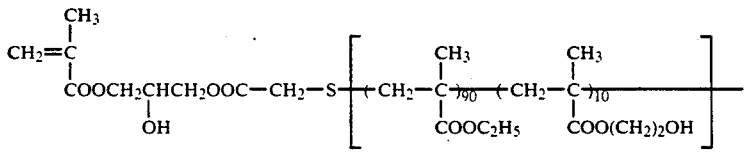

(MM-1)

PRODUCTION EXAMPLE 2 OF MACROMONOMER: (MM-2)

A mixture of 90 g of butyl methacrylate, 10 g of methacrylic acid, 4 g of 2-mercaptoethanol, and 200 g of tetrahydrofuran was heated to 70° C. under nitrogen gas stream and, after adding thereto 1.2 g of A.I.B.N., the reaction was carried out for 8 hours.

Then, after cooling the reaction mixture in a water bath to 20° C., 10.2 g of trimethylamine was added to the reaction mixture and then 14.5 g of methacrylic acid chloride was added dropwise to the mixture with stirring at a temperature below 25° C. Thereafter, the resulting mixture was further stirred for one hour. Then, after adding thereto 0.5 g of t-butyl hydroquinone, the mixture was heated to 60° C. and stirred for 4 hours. After cooling, the reaction mixture was added dropwise to one liter of water with stirring over a period of about 10 minutes, and the mixture was stirred for one hour. Then, the mixture was allowed to stand and water was removed by decantation. The mixture was washed twice with water and, after dissolving it in 100 ml of tetrahydrofuran, the solution was reprecipitated from 2 liter of petroleum ether. Precipitates thus formed were collected by decantation and dried under reduced pressure to obtain 65 g of the desired macromonomer as a viscous product. The weight average molecular weight of the product was $5.6\times10^3$.

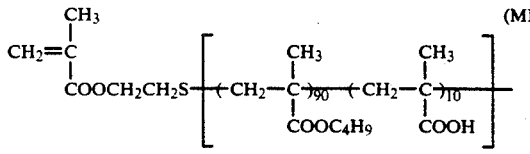

(MM-2)

PRODUCTION EXAMPLE 3 OF MACROMONOMER: (MM-3)

A mixture of 95 g of benzyl methacrylate, 5 g of 2-phosphonoethyl methacrylate, 4 g of 2-aminoethylmercaptan, and 200 g of tetrahydrofuran was heated to 70° C. with stirring under nitrogen gas stream.

Then, after adding 1.5 g of A.I.B.N. to the reaction mixture, the reaction was carried out for 4 hours and, after further adding thereto 0.5 g of A.I.B.N., the reaction was carried out for 4 hours. Then, the reaction mixture was cooled to 20° C. and, after adding thereto 10 g of acrylic acid anhydride, the mixture was stirred for one hour at a temperature of from 20° C. to 25° C. Then, 1.0 g of t-butylhydroquinone was added to the reaction mixture, and the resulting mixture was stirred for 4 hours at a temperature of from 50° C. to 60° C. After cooling, the reaction mixture was added dropwise to one liter of water with stirring over a period of about 10 minutes followed by stirring. The mixture was allowed to stand, and water was removed by decantation. The product was washed twice with water, dissolved in 100 ml of tetrahydrofuran and the solution was reprecipitated from 2 liters of petroleum ether. The precipitates formed were collected by decantation and dried under reduced pressure to obtain 70 g of the desired macromonomer as a viscous product. The weight average molecular weight was $7.4\times10^3$.

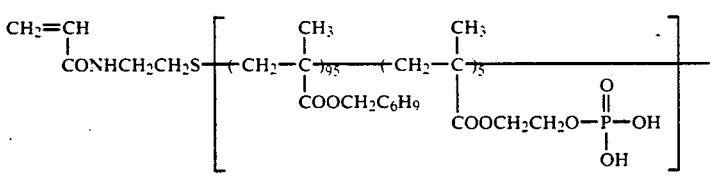

(MM-3)

PRODUCTION EXAMPLE 4 OF MACROMONOMER: (MM-4)

A mixture of 90 g of 2-chlorophenyl methacrylate, 10 g of a monomer (I) having the structure shown below, 4 g of thioglycolic acid and 200 g of toluene was heated to 70° C. under nitrogen gas stream.

Monomer (I):

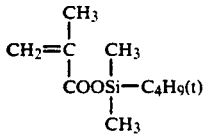

Then, 1.5 g of A.I.B.N. was added to the reaction mixture, and the reaction was carried out for 5 hours. After further adding thereto 0.5 g of A.I.B.N., the reaction was carried out for 4 hours. Then, after adding thereto 12.4 g of glycidyl methacrylate, 1.0 g of N,N-dimethyldodecylamine, and 1.5 g of t-butylhydroquinone, the reaction was carried out for 8 hours at 110° C. After cooling, the reaction mixture was added to a mixture of 3 g of p-toluenesulfonic acid and 100 ml of an aqueous solution of 90% by volume tetrahydrofuran, and the mixture was stirred for one hour at a temperature of from 30° C. to 35° C. The reaction mixture obtained was reprecipitated from 2 liters of a mixture of water and ethanol (⅓ by volume ratio) and the precipitates thus formed were collected by decantation and dissolved in 200 ml of tetrahydrofuran. The solution was represipitated from 2 liters of n-hexane to obtain 58 g of the desired macromonomer (MM-4) as a white powder. The weight average molecular weight thereof was $7.6\times10^3$.

(MM-4)

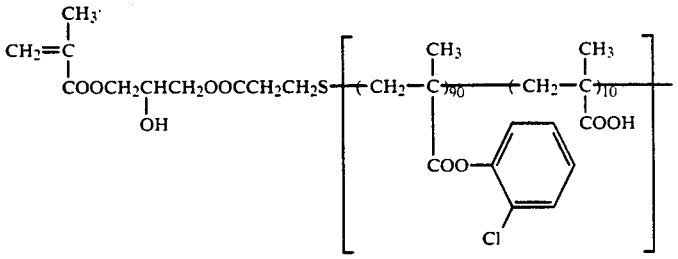

PRODUCTION EXAMPLE 5 OF MACROMONOMER: (MW-5)

A mixture of 95 g of 2,6-dichlorophenyl methacrylate, 5 g of 3-(2'-nitrobenzyloxysulfonyl)propyl methacrylate, 150 g of toluene and 50 g of isopropyl alcohol was heated to 80° C. under nitrogen gas stream. Then, after adding 5.0 g of 2,2'-azobis(2-cyanovaleric acid) (A.C.V.) to the reaction mixture, the reaction was carried out for 5 hours and, after further adding thereto 10 g of A.C.V., the reaction was carried out for 4 hours. After cooling, the reaction mixture was reprecipitated from 2 liters of methanol and the powder thus formed was collected and dried under reduced pressure.

A mixture of 50 g of the powder obtained in the aforesaid step, 14 g of glycidyl methacrylate, 0.6 g of N,N,-dimethyldocylamine, 1.0 g of t-butylhydroquinone, and 100 g of toluene was stirred for 10 hours at 110° C. After cooling to room temperature, the reaction mixture was irradiated with a high pressure mercury lamp of 80 watts with stirring for one hour. Thereafter, the reaction mixture was reprecipitated from one liter of methanol, and the powder formed was collected by filtration and dried under reduced pressure to obtain 34 g of the desired macromonomer (MM-5). The weight average molecular weight of the product was $7.3\times10^3$.

(MM-5)

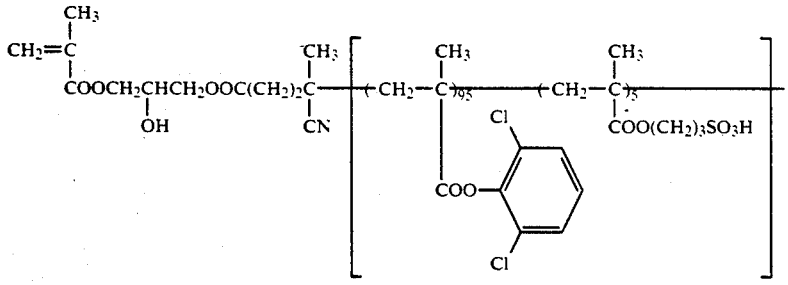

PRODUCTION EXAMPLE 1 OF RESIN (A): A-1

A mixture of 65 g of benzyl methacrylate, 15 g of methyl acrylate, and 20 g of the compound (MM-2) obtained in Production Example 2 of macromonomer, and 100 g of toluene was heated to 75° C. under nitrogen gas stream. After adding 1.5 g of A.I.B.N. to the reaction mixture, the reaction was carried out for 4 hours and, after further adding thereto 0.5 g of A.I.B.N., the reaction was carried out for 3 hours to obtain the desired resin (A-1). The weight average molecular weight of the product was $3.8\times10^4$.

(A-1)

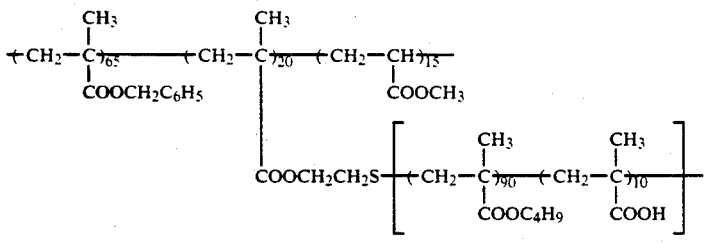

PRODUCTION EXAMPLE 2 OF RESIN (A): A-2

A mixture of 70 g of 2-chlorophenyl methacrylate, 30 g of the compound (MM-1) obtained in production example 1 of macromonomer, 3.0 g of thioglycolic acid, and 150 g of toluene was heated to 80° C. under nitrogen gas stream and, after adding thereto 1.0 g of A.I.B.N., the reaction was carried out for 4 hours. Then, 0.5 g of A.I.B.N. was added to the reaction mixture, and the reaction was carried out for 2 hours and after further adding 0.3 g of A.I.B.N., the reaction was further carried out for 3 hours to obtain the desired resin (A-2). The weight average molecular weight of the product was $8.5\times10^3$.

(A-2)

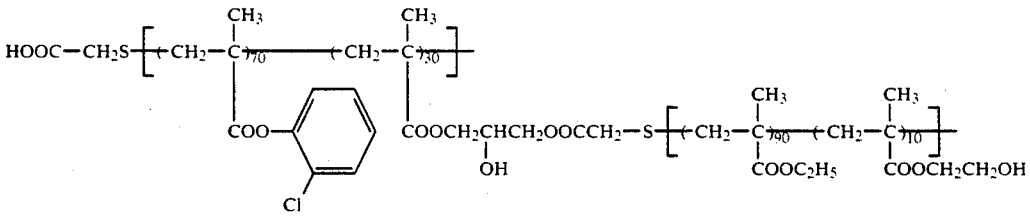

PRODUCTION EXAMPLE 3 OF RESIN (A): A-3

A mixture of 60 g of 2-chloro-6-methylphenyl methacrylate, 25 g of the compound (MM-4) obtained in Production Example 4 of macromonomer, 15 g of methyl acrylate, and 200 g of toluene was heated to 75° C. under nitrogen gas stream. Then, 0.8 of A.C.V. was added to the reaction mixture, and the reaction was carried out for 5 hours and, after further adding thereto 0.3 g of A.C.V., the reaction was carried out for 4 hours to obtain the desired resin (A-3). The weight average molecular weight of the product was $3.5\times10^4$.

(A-3)

-continued

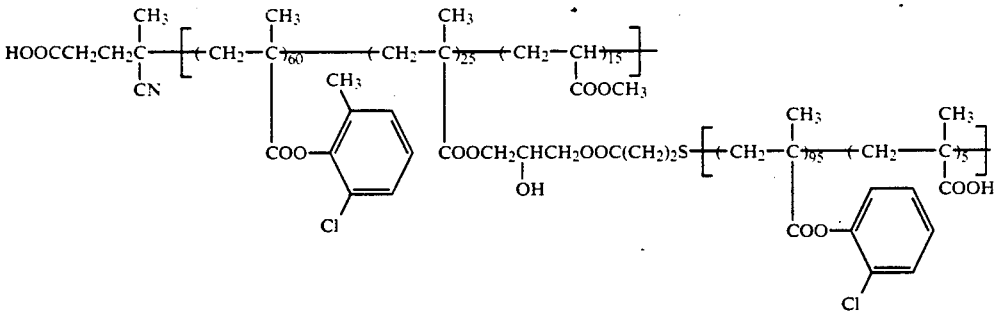

PRODUCTION EXAMPLE 4 OF RESIN (A): A-4

A mixture of 70 g of 2-chlorophenyl methacrylate, 30 g of the compound (MM-1) obtained in Production Example 1 of macromonomer, 3.0 g of β-mercaptopropionic acid, and 150 g of toluene was heated to 80° C. under nitrogen gas stream and, after adding thereto 1.0 g of A.I.B.N., the reaction was carried out for 4 hours. Then, 0.5 g of A.I.B.N. was added to the reaction mixture, the reaction was carried out for 2 hours and, after further adding thereto 0.3 g of A.I.B.N., the reaction was carried out for 3 hours to obtain the desired resin (A-4). The weight average molecular Weight of the product was $8.5\times10^3$.

(A-5)

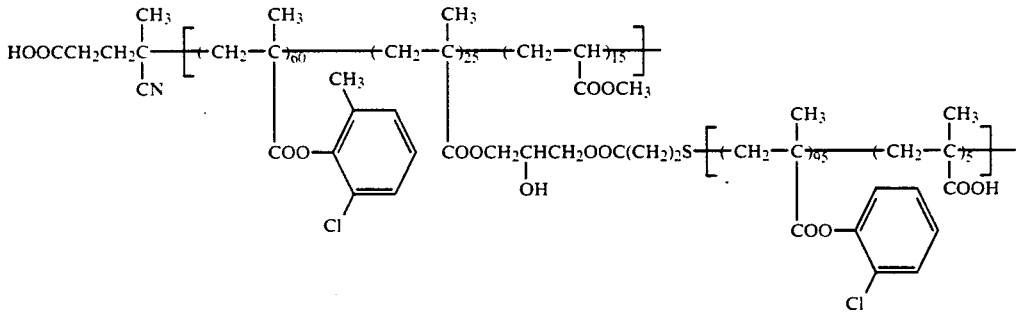

PRODUCTION EXAMPLE 5 OF RESIN (A): A-5

A mixture of 60 g of 2-chloro-6-methylphenyl methacrylate, 25 g of the compound (MM-4) obtained in Production Example 4 of macromonomer, 15 g of methyl acrylate, 100 g of toluene, and 50 g of isopropyl alcohol was heated to 80° C. under nitrogen gas stream. Then, 5 g of A.C.V. was added to the reaction mixture and the reaction was carried out for 5 hours, and, after further adding thereto 1 g of A.C.V., the reaction was carried out for 4 hours to obtain the desired resin (A-5). The weight average molecular weight of the product was $8.5\times10^3$.

(A-4)

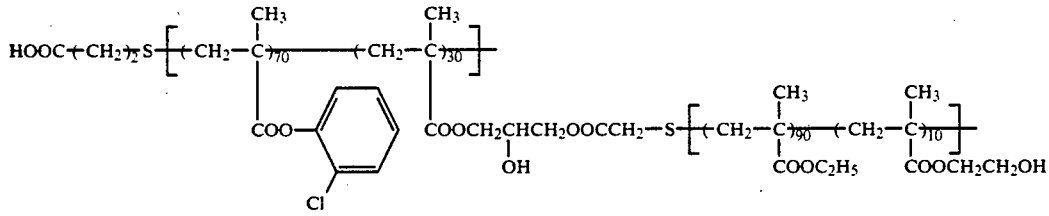

PRODUCTION EXAMPLES 6 TO 15 OF RESIN (A): A-16 TO A-15

By following similar procedures to the case of producing the resin (A-1) in Production Example 1 of Resin (A) described above, the resins (A) shown in Table 1 below were produced. The weight average molecular weights of these resins were in the range of from $6.0\times10^3$ to $9\times10^3$.

TABLE 1
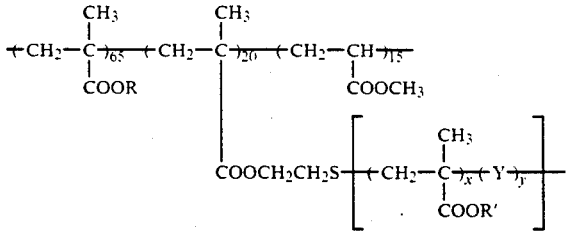
| Production Example | Resin (A) | R | R' | x/y (weight ratio) | —Y— |
|---|---|---|---|---|---|
| 6 | A-6 | $-C_2H_5$ | 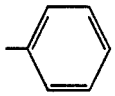 | 90/10 | $-CH_2-CH(COOH)-$ |
| 7 | A-7 | $-C_3H_7$ | 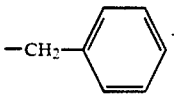 | 85/15 | $-CH_2-C(CH_3)(COO(CH_2)_2OCO(CH_2)_3COOH)-$ |
| 8 | A-8 | $-C_4H_9$ | 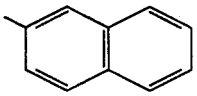 | 90/10 | $-CH_2-C(CH_3)(COO(CH_2)_2O-P(=O)(OH)-OH)-$ |
| 9 | A-9 | 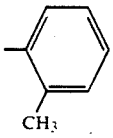 | $-CH_3$ | 90/10 | $-CH_2-CH(COOCH_2CH_2COOH)-$ |
| 10 | A-10 | 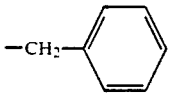 | $-C_2H_5$ | 90/10 | 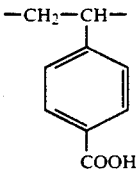 |
| 11 | A-11 | 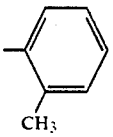 | $-C_4H_9$ | 92/8 | $-CH_2-C(CH_3)(COO(CH_2)_3SO_3H)-$ |
| 12 | A-12 | $-CH_3$ | 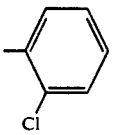 | 93/7 | $-CH_2-C(COOH)(CH_2COOH)-$ |
| 13 | A-13 | $-CH_3$ | $-C_2H_5$ | 90/10 | $-CH_2-C(CH_3)(COO(CH_2)_2-P(=O)(OH)-OCH_3)-$ |
| 14 | A-14 | 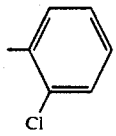 | $-C_2H_5$ | 95/5 | $-CH_2-C(CH_3)(COOH)-$ |

TABLE 1-continued

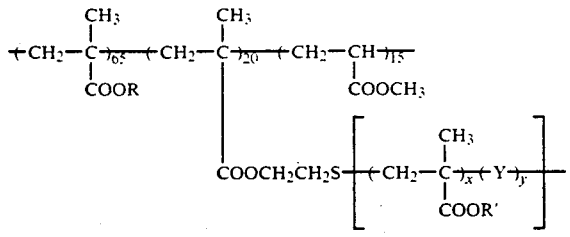

| Production Example | Resin (A) | R | R' | x/y (weight ratio) | —Y— |
|---|---|---|---|---|---|
| 15 | A-15 | 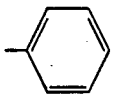 | 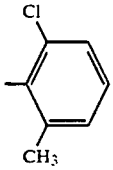 | 90/10 | 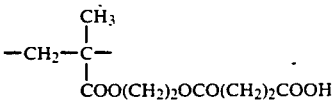 |

PRODUCTION EXAMPLES 16 TO 29 OF RESIN (A): A-16 TO A-29

By following similar procedures to the case of producing the resin (A-4) in Production Example 4 of Resin (A) described above, the resins (A) shown in Table 2 below were produced. The weight average molecular weights of the resins were in the range of from $5\times10^3$ to $9\times10^3$.

TABLE 2

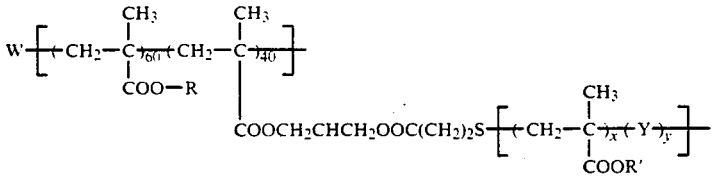

| Resin (A) | W— | R | R' | x/y (weight ratio) | —Y— |
|---|---|---|---|---|---|
| A-16 | HOOC—$H_2C$—S— | 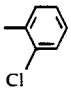 | —$C_2H_5$ | 90/10 | 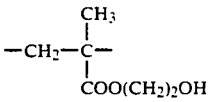 |
| A-17 | HOOC—$CH_2$<br>HOOC—CHS— | 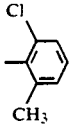 | 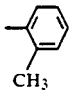 | 85/15 | 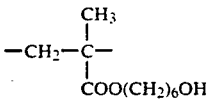 |
| A-18 | 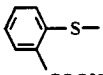 | 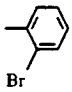 | 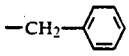 | 90/10 | 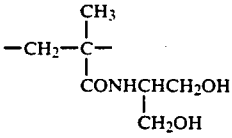 |
| A-19 | 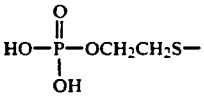 | —$C_2H_5$ | 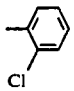 | 92/8 | 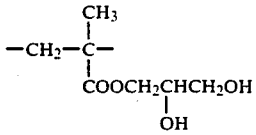 |
| A-20 | $HO_3SCH_2CH_2S$— | 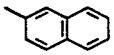 | —$C_4H_9$ | 93/7 | 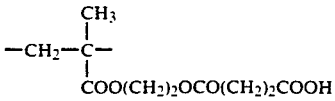 |

TABLE 2-continued

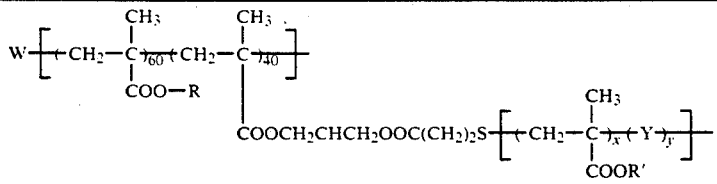

| Resin (A) | W— | R | R' | x/y (weight ratio) | —Y— |
|---|---|---|---|---|---|
| A-21 | $HOCH_2CH_2S$— | 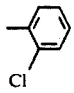 | $-C_2H_5$ | 92/8 | 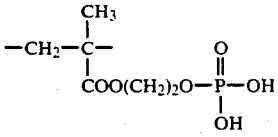 |
| A-22 | HOOC—$(CH_2)_2S$— | 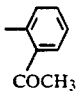 | $-C_3H_7$ | 95/5 | 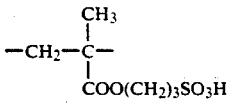 |
| A-23 | 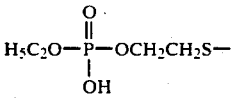 | 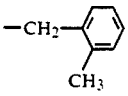 | 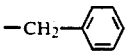 | 80/20 | 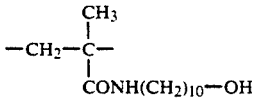 |
| A-24 | $HOOC(CH_2)_2S$— | 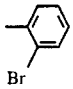 | $-C_2H_5$ | 90/20 | 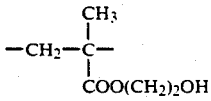 |
| A-25 | 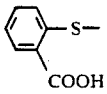 | 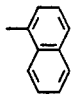 | $-C_3H_7$ | 90/10 | 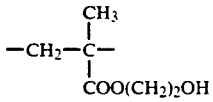 |
| A-26 | " | 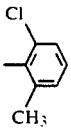 | 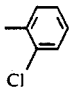 | 90/10 | 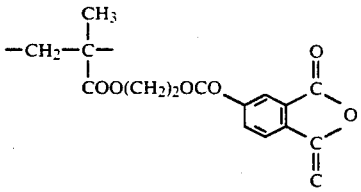 |
| A-27 | 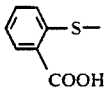 | 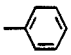 | $-CH_2C_6H_5$ | 85/15 | 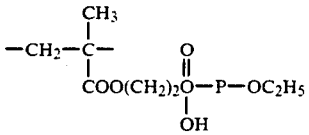 |
| A-28 | $HOOC(CH_2)_2S$— | 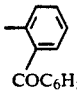 | $-C_4H_9$ | 95/5 | 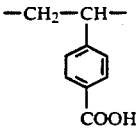 |
| A-29 | " | 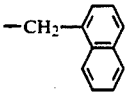 | 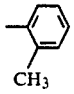 | 95/5 | 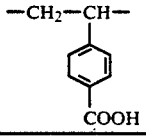 |

PRODUCTION EXAMPLES 30 TO 35 OF RESIN (A): A-30 TO A-35

By following similar procedures to the above procedures, the resins shown in Table 3 below were produced.

The weight average molecular weights of resins were in the range of from $6\times10^3$ to $9\times10^3$.

TABLE 3

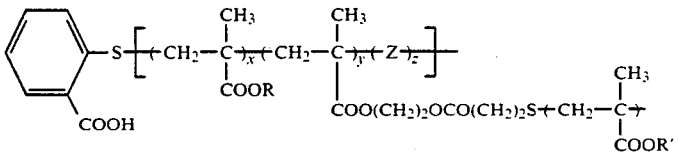

| Production Example | Resin (A) | R | —R' | —Z— | x/y/z |
|---|---|---|---|---|---|
| 30 | A-30 | 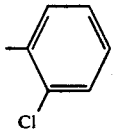 | $-C_2H_5$ | $-CH_2-C(CH_3)-COO(CH_2)_2OCO(CH_2)_5OH$ | 65/20/15 |
| 31 | A-31 | 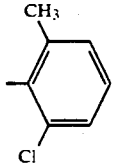 | $-CH_2C_6H_5$ | $-CH_2-C(CH_3)-COOCH_2CH(OH)CH_2OH$ | 70/20/10 |
| 32 | A-32 | 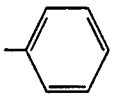 | $-CH_3$ | $-CH_2-C(CH_3)-COO(CH_2)_2OCO(CH_2)_5COOCH_2\overset{O}{\triangle}CHCH_2$ | 70/15/15 |
| 33 | A-33 | $-CH_2C_6H_5$ | 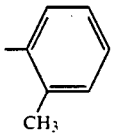 | $-CH_2-C(CH_3)-COO(CH_2)_2OCO(CH_2)_3COOCH_2CH=CH_2$ | 60/20/20 |
| 34 | A-34 | $-C_2H_5$ | $-C_2H_5$ | $-CH_2-C(CH_3)-COO(CH_2)_2OCOCH_2CH=CH-$ 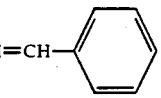 | 55/30/15 |
| 35 | A-35 | 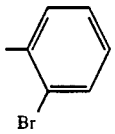 | $-CH_2C_6H_5$ | $-CH_2-C(CH_3)-COO(CH_2)_2OCO(CH_2)_{10}N$ 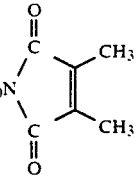 | 60/25/15 |

EXAMPLE 1 AND COMPARISON EXAMPLE A

A mixture of 40 g (as solid content) of the resin (A-1) produced in Production Example 1 of Resin (A), 200 g of zinc oxide, 0.018 g of a cyanine dye (I) having the structure shown below, 0.10 g of phthalic anhydride, and 300 g of toluene was dispersed in a ball mill for 2 hours to prepare a coating composition for a photoconductive layer. The composition was coated on a paper which had been subjected to an electroconductive treatment by a wire bar in a dry coating amount of 20 g/m$^2$ and dried for 30 seconds at 110° C. The coated product was allowed to stand in the dark for 24 hours under conditions of 20° C., 65% RH to obtain an electrophotographic light-sensitive material.

Cyanine Dye (I):

-continued

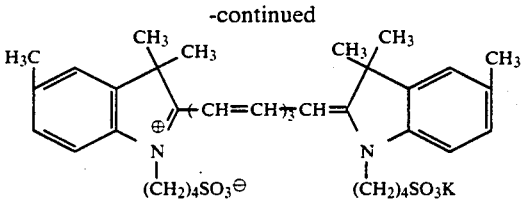

COMPARISON EXAMPLE A

By following the same procedure as above except that 40 g (as solid content) of a resin (P-1) having the structure shown below was used in place of the resin (A-1) for the binder resin, an electrophotographic light-sensitive material A was produced.

(P-1):

-continued

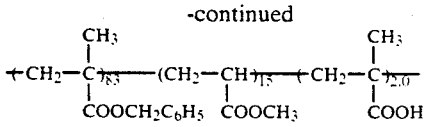

(weight ratio)

Weight average molecular weight: $3.2 \times 10^4$

On these light-sensitive materials, the coating property (surface smoothness), film strength, electrostatic charateristics, imaging property under atmospheric condition, and imaging property under the condition of 30° C., 80% RH were measured.

Furthermore, when each light-sensitive material was used as an offset printing master plate after processing and the oil- desensitizing property of the photoconductive layer (shown by the contact angle of the oil-desensitized photoconductive layer and water) and the printing property (background staining, printing durability, etc.) were determined.

TABLE 4

| | Example 1 | Comparison Example A |
|---|---|---|
| Smoothness of Photoconductive Layer*1) (sec/cc) | 98 | 88 |
| Strength of Photoconductive Layer*2) (%) | 88 | 90 |
| Electrophotographic Characteristics*3) | | |
| $V_{10}$ (−V) | 660 | 445 |
| DRR (%) | 78 | 40 |
| $E_{1/10}$ (erg/cm$^2$) | 39 | 21 |
| Imaging Property*4) | | |
| I: (20° C., 65%) | ○ good | X Dm lowered. fine line cut |
| II: (30° C., 80%) | ○ good | XX Dm lowered. densities of fines and letters lowered |
| Contact Angle with Water*5) | 10 | 18 |
| Printing Durability*6 | 8,000 prints | Fine line print from the 1st print |

The evaluation items shown in Table 4 above were conducted as follows.

*1) Smoothness of Photoconductive Layer

The smoothness (sec/cc) of each light-sensitive material was measured using a Beck Smoothness Test Machine (manufactured by Kumagaya Riko K. K.) under an air volume of 1 cc.

*2 Machanical Strength of Photoconductive Layer

The surface of each light-sensitive material was repeatedly rubbed with emery paper (#1000) under a load of 50 g/cm$^2$ using a Heidon 14 Model surface testing machine (manufactured by Shinto Kagaku K. K.). After removing abrasion dusts from the layer, the film retension (%) was determined from the weight loss of the photoconductive layer, which was employed as the mechanical strength of the layer.

*3) Electrostatic Characteristics

Each light-sensitive material was charged by applying thereto corona discharging of −6 kV for 20 seconds using a paper analyzer (Paper Analyzer Type SP-428, manufactured by Kawaguchi Denki K. K.) in the dark at 20° C., 65% RH and then allowed to stand for 10 seconds. The surface potential $V_{10}$ in this case was measured. Then, the sample was allowed to stand for 180 seconds in the dark and then the potential $V_{180}$ was measured. The dark decay retention [DRR (%)], i.e., the percent retention of potential after decaying for 180 seconds in the dark, was calculated from the following formula:

$$DRR\ (\%) = (V_{180}/V_{10}) \times 100$$

Also, the surface of the photoconductive layer was charged to −400 volts by corona discharging, then irradiated by monochromatic light of a wavelength of 780 n.m., the time required for decaying the surface potential $V_{10}$ to 1/10 thereof, and the exposure amount $E_{1/10}$ (erg/cm$^2$) was calculated therefrom.

*4) Imaging Property

Each light-sensitive material was allowed to stand a whole day and night under the surrounding condition (I) of 20° C., 65% RH or the surrounding condition (II) of 30° C., 80% RH. Then, each sample was charged to −5 kV, exposed by scanning with a gallium-aluminum-arsenic semiconductor laser (oscillation wavelength 780 n.m.) of 2.8 mW in output as a light source at an exposure amount on the surface of 64 erg/cm$^2$, at a pitch of 25 μm, and a scanning speed of 300 m/sec., and developed using ELP-T (trade name, made by Fuji Photo Film Co., Ltd.) as a liquid developer followed by fixing. Then, the reproduced images (fog, image quality) were visually evaluated.

*5) Contact Angle with Water

Each light-sensitive material was passed once through an etching processor using an oil desensitizing solution ELP-EX (trade name, made by Fuji Photo Film Co., Ltd.) to desensitize the surface of the photoconductive layer. Then, one drop of distilled water (2 μl) was placed on the surface, and the contact angle between the surface and the water drop formed thereon was measured using a goniometer.

*6) Printing Durability

Each light-sensitive material was processed in the same manner as described in *4), the sample was oil desensitized under the same condition as in *5) described above, and the printing plate thus prepared was mounted on an offset printing machine (Oliver Model 52, manufactured by Sakurai Seisakusho K. K.) as an offset master plate following by printing. Then, the number of prints obtained without causing background staining on the non image portions of prints and problems on the quality of the image portions was employed as the printing durability. The larger the number of prints, the higher the printing durability.

As shown in Table 4, it can be seen that the light-sensitive material of this invention was excellent in the smoothness of the photoconductive layer and electrostatic characteristics (in particular, charging property) as well as the reproduced images formed by processing had no background stains and had clear image quality. This is assumed to be based on that the binder resin suitably adsorbed on the photoconductive particles and suitably covered the surface of the particles as well as did not hinder the adsorption of spectral sensitizing dyes onto the particles.

When the light-sensitive material was used as an offset master plate after processing, the photoconductive layer was sufficiently oil-desensitized by an oil-desensitizing solution for the same reason as above and the contact angle between the non-image portion and water was as low as below 15 degrees, which showed that the layer was sufficiently rendered hydrophilic. At printing, no background staining of prints was observed.

On the other hand, in the case of the light-sensitive material in Comparison Example A, the film strength was sufficiently high, but electrostatic characteristics, in particular, DRR was greatly reduced and, at practical imaging, a satisfactory reproduced image was not obtained. Also, $E_{1/10}$ was lowered in appearance but this was caused by the reduction of DRR and was different from so-called good photoconductive property of causing a photoconductivity by light irradiation. This is assumed that the resin, which was a conventional random copolymer, in the conventional example covers the surface of the zinc oxide particles too strongly to hinder the adsorption of spectral sensitizing dyes onto the particles, whereby the electrostatic characteristics were reduced and, when the oil desensitizing treatment was applied to the photoconductive layer, etching of the zinc oxide particles did not sufficiently proceed.

Thus, only the light-sensitive material according to the present invention was found to be excellent in all the points of surface smoothness of the photoconductive layer, film strength, electrostatic characteristics, and printing durability.

EXAMPLES 2 TO 9

By following the same procedure as Example 1 except that 40 g of each of resins (A) shown in Table 5 below was used in place of 40 g of the resin (A-1), each electrophotographic light-sensitive material was prepared.

TABLE 5

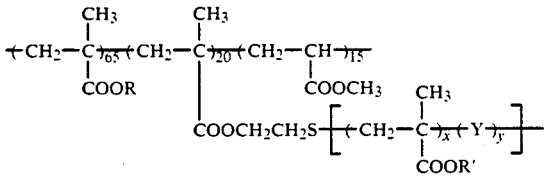

| Production Example | Resin (A) | R | R' | x/y (weight ratio) | —Y— |
|---|---|---|---|---|---|
| 2 | A-36 | $-C_2H_5$ | 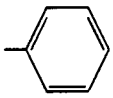 | 90/10 | $-CH_2-CH-$ (COOH) |
| 3 | A-37 | $-C_3H_7$ | 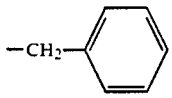 | 85/15 | $-CH_2-C(CH_3)-$ $COO(CH_2)_2OCO(CH_2)_3COOH$ |
| 4 | A-38 | $-C_4H_9$ | 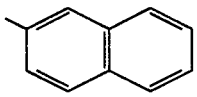 | 90/10 | $-CH_2-C(CH_3)-$ $COO(CH_2)_2O-P(=O)(OH)-OH$ |
| 5 | A-39 | 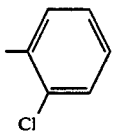 | $-CH_3$ | 90/10 | $-CH_2-CH-$ $COOCH_2CH_2COOH$ |
| 6 | A-40 | 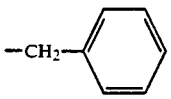 | $-C_2H_5$ | 90/10 | $-CH_2-CH-$ 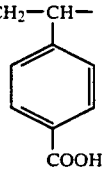 |
| 7 | A-41 | 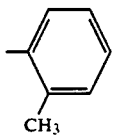 | $-C_4H_9$ | 92/8 | $-CH_2-C(CH_3)-$ $COO(CH_2)_3SO_3H$ |

TABLE 5-continued

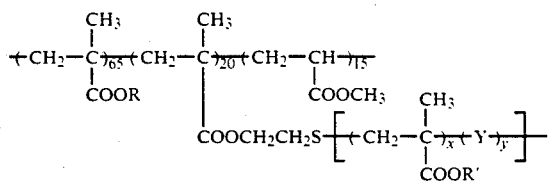

| Production Example | Resin (A) | R | R' | x/y (weight ratio) | —Y— |
|---|---|---|---|---|---|
| 8 | A-42 | $-CH_3$ | 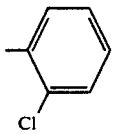 | 93/7 | 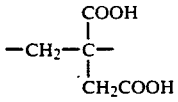 |
| 9 | A-43 | $-CH_3$ | $-C_2H_5$ | 90/10 | 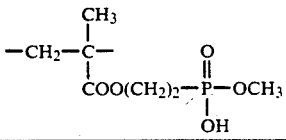 |

The electrostatic characteristics of each light-sensitive material measured in the same manner as in Example 1 were excellent, and clear reproduced images having no background fog were obtained even under the high-temperature high-humidity condition (30° C., 80% RH). Also, when each light-sensitive material was used for printing as an offset master plate after processing, more than 8,000 prints having no background fog and having clear images could be obtained.

EXAMPLE 10

By following the same procedure as Example 1 except that 40 g of the resin (A-3) produced in Production Example 3 of Resin (A) was used in place of 40 g of the resin (A-1) and 0.020 g of a dye (II) having the structure shown below was used in place of 0.018 g of the cyanine dye (I), an electrophotographic light-sensitive material was prepared.

Dye (II):

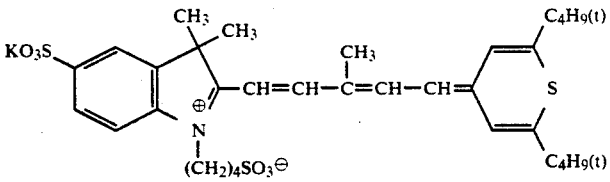

The light-sensitive material was evaluated as in Example 1, and found to have the surface smoothness of 100 (sec/cc), the strength of the photoconductive layer of 85%, $V_{10}$ of −560 volts, DRR of 85%, and $E_{1/10}$ of 42 (erg/cm$^2$). At imaging, clear reproduced images were obtained under atmospheric conditions and the high-temperature and high-humidity conditions.

Then, the sample was subjected to an etching treatment (oil desensitizing treatment) under the same condition as in Example 1 and used for printing as an offset master, 8,000 prints having clear images were obtained.

As described above, the electrophotographic light-sensitive material using the binder resin according to the present invention are excellent in electrophotographic characteristics and printing durability.

EXAMPLE 11

By following the same procedure as Example 1 except that 6 g (as solid content) of the resin (A-2) produced in Production Example 2 of Resin (A) and 34 g of a polyethylene methacrylate having a weight average molecular weight of $3.6\times10^5$ (resin (B-1)) were used in place of 40 g of the resin (A-1), an electrophotographic light-sensitive material was prepared. The light-sensitive material was evaluated as in Example 1, and found to have the surface smoothness of 105 (sec/cc), the strength of the photoconductive layer of 93%, $V_{10}$ of −650 volts, DRR of 86%, and $E_{1/10}$ of 26 (erg/cm$^2$). Also, at imaging, clear reproduced images were obtained under atmospheric conditions and under the high temperature high-humidity conditions. Also, when the sample was used for printing as an offset master plate, more than 10,000 prints having clear images and no background fog were obtained.

EXAMPLE 12 to 19

By following the same procedure as Example 11 except that 6 g of the resin (A) shown in Table 3 was used in place of 6 g of the resin (A-2), each of photoelectric light-sensitive materials was prepared.

TABLE 6

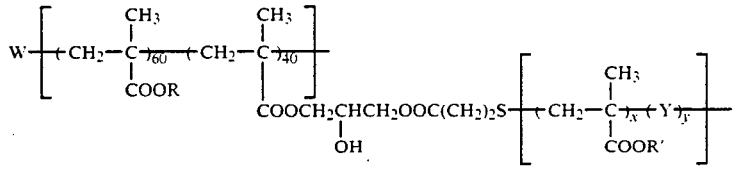

| Production Example | Resin (A) | W— | R | R' | x/y (weight ratio) | —Y— |
|---|---|---|---|---|---|---|
| 12 | A-44 | HOOC—$H_2C$—S— | 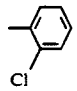 | —$C_2H_5$ | 90/10 | 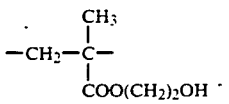 |
| 13 | A-45 | HOOC—$CH_2$<br>HOOC—CHS— | 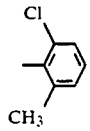 | 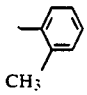 | 85/15 | 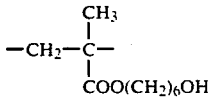 |
| 14 | A-46 | 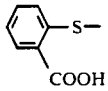 | 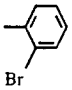 | —$CH_2$— 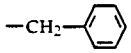 | 90/10 | 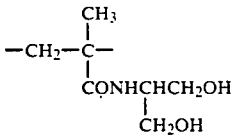 |
| 15 | A-47 | 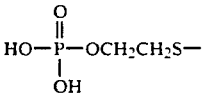 | —$C_2H_5$ | 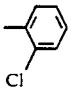 | 92/8 | 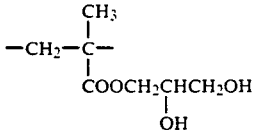 |
| 16 | A-48 | $HO_3SCH_2CH_2S$— | 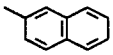 | —$C_4H_9$ | 93/7 | 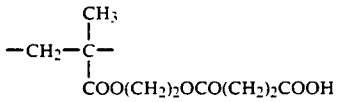 |
| 17 | A-49 | $HOCH_2CH_2S$— | 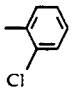 | —$C_2H_5$ | 92/8 | 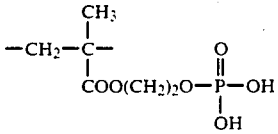 |
| 18 | A-50 | HOOC—$(CH_2)_2S$— | 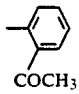 | —$C_3H_7$ | 95/5 | 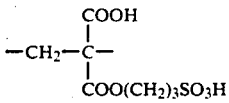 |
| 19 | A-51 | 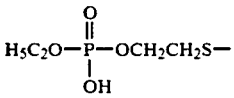 | 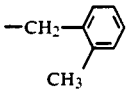 | —$CH_2$— 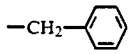 | 80/20 | 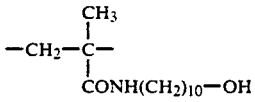 |

Each of the light-sensitive materials was excellent in the charging property, dark charge retentivity, and light-sensitivity and gave clear images having neither background fog nor fine line cutting even under severe conditions of high temperature and high humidity (30° C., 80% RH).

Furthermore, when each sample was used for printing as an offset master plate, more than 10,000 prints having clear images and no background fog at the non-image portions were obtained.

EXAMPLES 20 to 25

By following the same procedure as Example 11 except that 7 g of each of resins (A) shown in Table 7 was used in place of 6 g of the resin (A-2) and 33 g of each of resins (B) shown in Table 7 was used in place of 34 g of the resin (B-1), each of electrophotographic light-sensitive materials was produced.

TABLE 7

| Example No. | Resin (A) | Resin (B) Structure | Weight Average Molecular weight |
|---|---|---|---|
| 20 | (A-44) | (B-2) Poly(butylmethacrylate) | $3.6 \times 10^5$ |
| 21 | (A-45) | (B-3) Poly(benzylmethacrylate) | $3.0 \times 10^5$ |
| 22 | (A-46) | (B-4) Poly(methylmethacrylate) | $2.2 \times 10^5$ |
| 23 | (A-47) | (B-5) Poly(styrene/ethylmethacrylate: 3/2 by weight) | $3.0 \times 10^5$ |
| 24 | (A-48) | (B-6) Polystyrene | $2.0 \times 10^5$ |
| 25 | (A-49) | (B-7) Polyvinylacetate | $3.0 \times 10^5$ |

Each of the light-sensitive materials thus obtained showed excellent characteristics and also, when the sample was used for printing as an offset master plate, more than 10,000 prints having clear images were obtained.

EXAMPLES 26 to 35

A mixture of 8 g (as solid content) of resin (A-52) having the structure shown below, 32 g of each of resins (C) shown in Table 8, 0.02 g of heptamethinecyanine dye (III) having the structure shown below, 0.15 g of phthalic anhydride, and 300 g of toluene was dispersed in a ball mill for 2 hours to prepare a coating composition for a photoconductive layer. Then, by following the same procedure as Example 1 using the above coating composition, each electrophotographic light-sensitive materials was produced.

Resin (A-52):

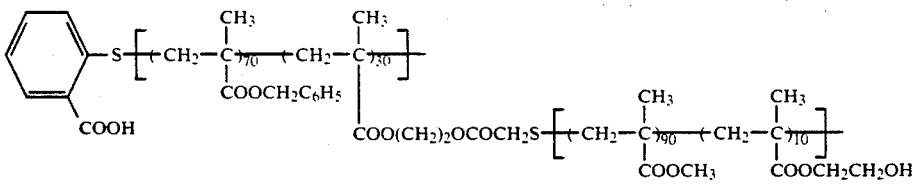

Weight average molecular weight: $8.6 \times 10^3$

Cyanine Dye (III):

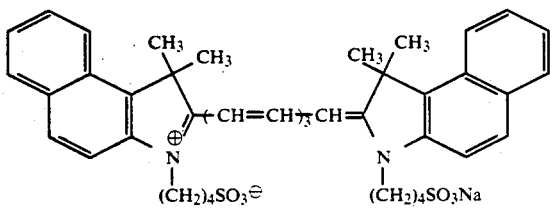

TABLE 8

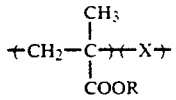

| Resin (C) | R | —X— | Weight Average Molecular weight ($\times 10^4$) |
|---|---|---|---|
| C-1 | $-C_2H_5$ 96 | $CH_2-C(CH_3)(COOCH_2CH_2OH)$ 4 | 12 |
| C-2 | $-C_2H_5$ 95 | $CH_2-C(CH_3)(COO(CH_2)_{10}OH)$ 5 | 9.5 |
| C-3 | $-C_4H_9$ 98 | $CH_2-C(CH_3)(CONHC(CH_2OH)_2-CH_3)$ 2 | 10 |
| C-4 | $-C_4H_9$ 97 | $CH_2-C(CH_3)(CONH(CH_2)_{10}OH)$ 3 | 11.5 |
| C-5 | $-C_4H_9$ 96 | $CH_2-CH$ (benzene ring, $CH_2OH$) 4 | 20 |
| C-6 | $-C_2H_5$ 95 | $CH_2-C(CH_3)(COO(CH_2)_2N(CH_3)_2)$ 5 | 8.8 |
| C-7 | $-C_3H_7$ 95 | $CH_2-C(CH_3)(COO(CH_2)_2N(CH_3)C_6H_5)$ 5 | 9.5 |

TABLE 8-continued

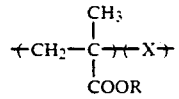

| Resin (C) | R (The numerical values in Table indicate weight composition ratios) | —X— | Weight Average Molecular weight (× $10^4$) |
|---|---|---|---|
| C-8 | —$C_4H_9$ 96 | 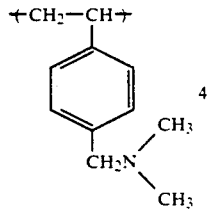 4 | 10.5 |
| C-9 | —$C_2H_5$ 97 | 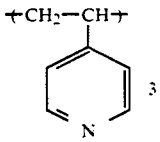 3 | 10.5 |
| C-10 | —$C_4H_9$ 95 | 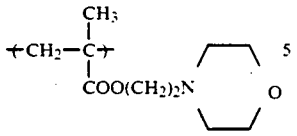 5 | 13 |

On these light-sensitive materials, the electrostatic characteristics were measured using the paper analyzer as in Example 1. In this case, however, a gallium-aluminum-arsenic semiconductor laser (oscillation wavelength 830 nm) was used as a light source.

The results obtained are shown in Table 9 below.

TABLE 9

| Example No. | Resin (C) | $V_{10}$ (−V) | D.R.R. | $E_{1/10}$ (erg/cm$^2$) | Imaging Property (30° C., 80% RH) | Printing Durability (No. of Prints) |
|---|---|---|---|---|---|---|
| 26 | C-1 | 600 | 85 | 30 | good | 8,000 |
| 27 | C-2 | 605 | 86 | 30 | " | 8,000 |
| 28 | C-3 | 585 | 82 | 29 | " | 9,000 |
| 29 | C-4 | 590 | 83 | 30 | " | 9,000 |
| 30 | C-5 | 575 | 80 | 28 | " | 8,000 |
| 31 | C-6 | 565 | 79 | 32 | " | 8,000 |
| 32 | C-7 | 570 | 80 | 31 | " | 8,000 |
| 33 | C-8 | 575 | 82 | 31 | " | 8,000 |
| 34 | C-9 | 590 | 84 | 30 | " | 8,000 |
| 35 | C-10 | 560 | 79 | 30 | " | 8,000 |

EXAMPLES 36 to 47

A mixture of 8 g of the resin (A-21) having the structure shown below, 32 g of each of resins (D) shown in Table 10 below, 0.018 g of the cyanine dye (I) as used in Example 1, 0.15 g of maleic anhydride, 200 g of zinc oxide, and 300 g of toluene was dispersed in a ball mill for 2 hours to prepare a coating composition for a photoconductive layer. Then, by following the same procedure as in Example 1 using the coating composition, each of electrophotographic light-sensitive materials was produced.

Resin (A-53):

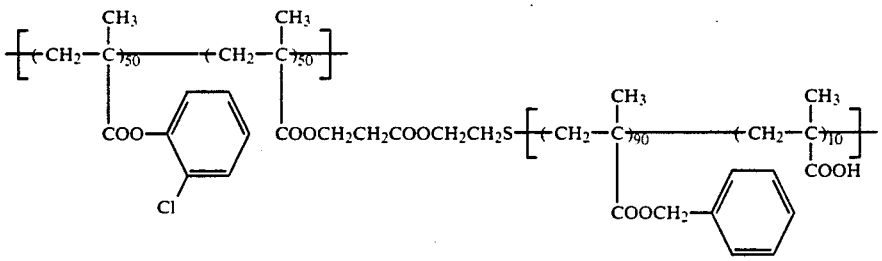

Weight average molecular weight: 8.5 × $10^3$

TABLE 10

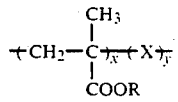

(x and y: weight ratio)

| Example No. | Resin (D) | R. x | —X— | y | Weight Average Molecular Weight (× $10^5$) |
|---|---|---|---|---|---|
| 36 | D-1 | $-C_2H_5$ 99.5 | $+CH_2-CH+$ (COOH) | 0.5 | 1.8 |
| 37 | D-2 | $-C_2H_5$ 99.5 | $+CH_2-C+$ ($CH_3$, COOH) | 0.5 | 2.0 |
| 38 | D-3 | $-C_2H_5$ 99.2 | $+CH_2-C+$ ($CH_3$, $CONH(CH_2)_{10}COOH$) | 0.8 | 2.1 |
| 39 | D-4 | $-C_4H_9$ 99.7 | $+CH_2-C+$ ($CH_3$, $COO(CH_2)_2OP(=O)(OH)-OH$) | 0.3 | 2.5 |
| 40 | D-5 | $-C_4H_9$ 99.7 | $+CH_2-C+$ ($CH_3$, $COO(CH_2)_3SO_3H$) | 0.3 | 1.5 |
| 41 | D-6 | $-C_2H_5$ 99.5 | $+CH_2-CH+$ (C6H4-COOH) | 0.5 | 1.1 |
| 42 | D-7 | $-CH_2C_6H_5$ 99.4 | $+CH_2-C+$ ($CH_3$, $COO(CH_2)_2OCO(CH_2)_3COOH$) | 0.6 | 2.1 |
| 43 | D-8 | $-C_3H_7$ 99.4 | $+CH_2-C+$ ($CH_3$, $CH_3$) | 0.6 | 2.2 |
| 44 | D-9 | $-C_4H_9$ 99.5 | $+CH_2-C+$ ($CH_3$, CONH-C6H4-COOH) | 0.5 | 2.0 |
| 45 | D-10 | $-C_3H$ 99.7 | $+CH_2-CH+$ ($COO(CH_2)_2OCO$-C6H3(COOH)-COOH) | 0.3 | 2.1 |
| 46 | D-11 | C6H4-$CH_3$ 99.7 | $+CH_2-CH+$ (C6H4-$SO_3H$) | 0.3 | 1.6 |

TABLE 10-continued

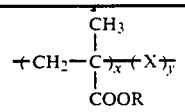

(x and y: weight ratio)

| Example No. | Resin (D) | R. x | —X— | y | Weight Average Molecular Weight (× $10^5$) |
|---|---|---|---|---|---|
| 47 | D-12 | —$COOC_3H_7$ 99.4 | $\leftarrow CH_2-CH\rightarrow$ (COO$(CH_2)_2$COOH) | 0.6 | 2.2 |

Each of the light-sensitive materials was excellent in the charging property, dark charge retentivity, and light sensitivity and provided clear images having neither background fog nor fine line cutting even under severe conditions (30° C., 80% RH) at practical imaging.

Furthermore, when each sample was used for printing as an offset master plate after processing, 10,000 prints having clear images and no background staining were obtained.

Resin (A-54):

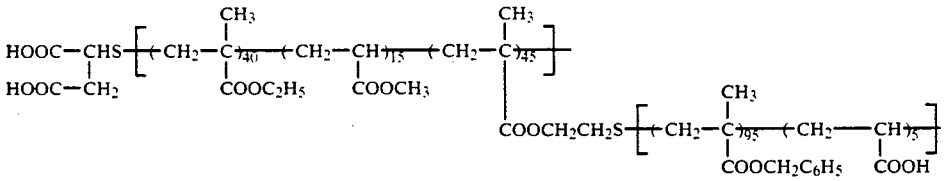

Weight average molecular weight: 8.1 × $10^3$.

EXAMPLES 48 TO 53 AND COMPARISON EXAMPLE B

A mixture of 8 g of resin (A-54) having the structure shown below, 32 g of each of resins (B), (C), and (D) shown in Table 11 below, 200 g of zinc oxide, 0.02 g of uranine, 0.04 g of Rose Bengal, 0.03 g of bromophenol blue, 0.20 g of phthalic anhydride, and 300 g of toluene was dispersed in a ball mill for 2 hours to prepare a coating composition for a photoconductive layer. The composition was coated on a paper which had been subjected to an electroconductive treatment by a wire bar in a dry coating amount of 20 g/$m^2$ and dried for one minute at 110° C. Then, the coated product was allowed to stand for 24 hours in the dark under the conditions of 20° C., 65% RH to obtain each of the electrophotographic light-sensitive materials.

Each of the resulting electrophotographic light-sensitive materials was evaluated by the test methods as described hereinafter. The printing durability of the offset master plate prepared from the light-sensitive material was evaluated in the same manner as described in Example 1.

The results obtained are shown in Table 11 below.

TABLE 11

Resin (B) ~ (D)

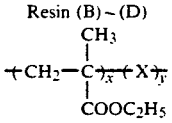

Average molecular weight of Resins (B) to (D) is 1.5 × $10^5$ to 2.5 × $10^5$

| Example | x/y (weight ratio) | —X— | Electrophotographic*8) characteristics (30° C., 80% RH) $V_{10}$ (−V) | D.R.R (%) | $E_{1/10}$ (lux · sec) | Printing Durability (No. of Prints) |
|---|---|---|---|---|---|---|
| 48 | 100/0 | — | 585 | 90 | 6.0 | 8,000 |
| 49 | 96/4 | $\leftarrow CH_2-C\rightarrow$ (COO$(CH_2)_2$OH) | 560 | 91 | 5.5 | " |
| 50 | 95.5 | $\leftarrow CH_2-C\rightarrow$ (COO$(CH_2)_2$— 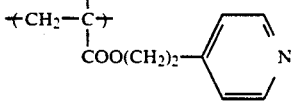 | 550 | 89 | 6.1 | " |

TABLE 11-continued

Resin (B)~(D)

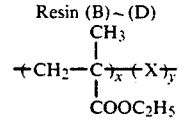

Average molecular weight of Resins (B) to (D) is $1.5 \times 10^5$ to $2.5 \times 10^5$

| Example | x/y (weight ratio) | —X— | Electrophotographic*8) characteristics (30° C., 80% RH) $V_{10}$ (−V) | D.R.R (%) | $E_{1/10}$ (lux · sec) | Printing Durability (No. of Prints) |
|---|---|---|---|---|---|---|
| 51 | 99.6/0.4 | 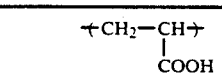 | 595 | 94 | 5.3 | more than 10,000 |
| 52 | 99.7/0.3 | 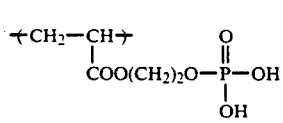 | 585 | 94 | 5.4 | " |
| 53 | 99.7/0.3 | 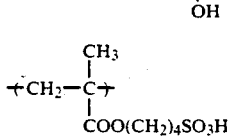 | 580 | 93 | 5.5 | " |
| B | | 40 g of Resin (P-1) only of Comparison Example A used | 550 | 84 | 16.0 | Background stain occurred from the 1st print. |

Electrostatic Characteristics

After applying corona discharging of 6 kV each of the light-sensitive materials for 20 seconds in the dark under the conditions of 20° C., 65% RH using a paper analyzer (Paper Analyzer Type SP-428, manufactured by Kawaguchi Denki K. K.), the light-sensitive material was allowed to stand for 10 seconds and the surface potential $V_{10}$ in this case was measured. Then, the sample was allowed to stand for 60 seconds in the dark, the potential $V_{70}$ was measured. Then, the dark decay detentivity [DRR (%)], i.e., the potential retention after dark decaying for 60 seconds was calculated by the following formula:

$$DRR\ (\%) = V_{70}/V_{10} \times 100\ (\%)$$

Also, after charging the surface of the photoconductive layer to −400 volts by corona discharging, the surface of the photoconductive layer was exposed to visible light of 2.0 lux, the time required to decaying the surface potential $V_{10}$ to 1/10 thereof, and the exposure amount $E_{1/10}$(lux·sec.) was calculated therefrom.

Imaging Property

Each of the light-sensitive materials was allowed to stand a whole day and night under the condition (I) of 20° C., 65% RH or the condition (II) of 30° C., 80% RH and images were formed by an automatic plate making machine ELP-404V (trade name, manufactured by Fuji Photo Film Co., Ltd.) using ELP-T (trade name, made by Fuji Photo Film Co., Ltd.) as a toner. Then, the reproduced images (fog, image quality) were visually evaluated.

For the light-sensitive materials in the examples of this invention and Comparison Example B, 3 kinds of spectral sensitizing dyes sensitizing in a visible light region were used. In the light-sensitive material in Comparison Example B using a conventional random copolymer for the binder resin, electrophotographic characteristics were satisfactory, but, when the light-sensitive material was used for printing as an offset master plate, the application of oil-desensitizing treatment to the non-image portions was insufficient and a background stain occurred from the 1st print.

On the other hand, the light-sensitive materials of this invention did not show such problems and more than 8,000 prints having clear images and no background stain were obtained.

EXAMPLE 54

A mixture of 38 g (as solid content) of the resin (A-22) produced in Production Example 22 of Resin (A), 200 g of zinc oxide, 0.02 g of a heptamethine cyanine dye (III) having the structure shown below, 0.30 g of phthalic anhydride, and 300 g of toluene was dispersed in a ball mill for 3 hours and, after adding thereto 2 g of 1,3-xylylene diisocyanate, the resulting mixture was dispersed for 10 minutes in a ball mill.

The dispersion was coated on a paper which had been subjected to an electroconductive treatment by a wire bar in a dry coating amount of 22 g/m² and dried for 15 seconds at 100° C. and then for 2 hours at 120° C. Then, the coated product was allowed to stand in the dark of 20° C. and allowed to stand for 24 hours under the condition of 20° C., 65% RH to obtain an electrophotographic light-sensitive material.

Cyanine Dye (III):

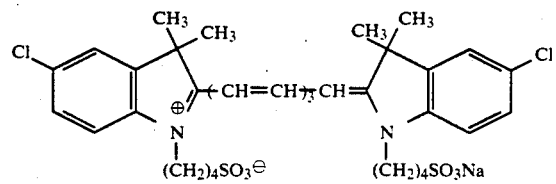

EXAMPLE 55

A mixture of 40 g (a solid content) of resin (A-22), 200 g of zinc oxide, 0.02 g of the cyanine dye (III) described above, 0.30 g of phthalic anhydride and 300 g of toluene was dispersed in a ball mill for 2 hours.

The dispersion was coated on a paper which had been subjected to an electroconductive treatment by a wire bar in a dry coating amount of 22 g/m$^2$ and dried for 15 seconds at 100° C. The coated product was allowed to stand for 4 hours in the dark under conditions of 20° C., 65% RH to obtain an electrophotographic light-sensitive material.

COMPARISON EXAMPLE C

By following the same procedure as Example 54 except that 38 g of resin (R-1) (weight average molecular weight: $7.5\times10^3$) having the structure shown below was used in place of 38 g of the resin (A-22), an electrophotographic light-sensitive material was prepared.

Resin (R-1):

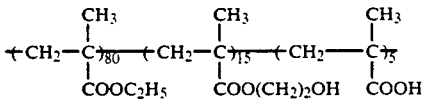

COMPARISON EXAMPLE D

By following the same procedure as Example 55 except that 40 g of resin (R-2) having the structure shown below was used in place of 40 g of the resin (A-22), an electrophotographic light-sensitive material was prepared.

Resin (R-2):

-continued

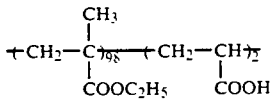

Weight average molecular weight: 34,000.

On these light-sensitive materials, the coating property (surface smoothness), electrostatic characteristics, imaging property under atmospheric condition, and imaging property under the surrounding condition of 30° C., 80% RH were determined.

Furthermore, each sample was used as an offset master plate after processing and the oil-desensitizing property of the photoconductive layer (shown by the contact angle between the oil-desensitized photoconductive layer and water) and the printing properties (background staining, printing durability, etc.) were determined.

The results obtained are shown in Table 12 below.

TABLE 12

| | Example 54 | Example 55 | Comparison Example C | Comparison Example D |
|---|---|---|---|---|
| Smoothness of Photo-*1) conductive Layer (sec/cc) | 120 | 130 | 120 | 95 |
| Strength of Photo-*2) conductive layer (%) | 95 | 60 | 88 | 85 |
| Electrophotographic*3) Characteristics | | | | |
| $V_{10}$ (−V) | | | | |
| I: (20° C., 65%) | 580 | 610 | 480 | 400 |
| II: (30° C., 80%) | 650 | 595 | 410 | 280 |
| DRR (%) | | | | |
| I: (20° C., 65%) | 83 | 86 | 60 | 41 |
| II: (30° C., 80%) | 79 | 82 | 56 | 18 |
| $E_{1/10}$ (erg/cm$^2$) | | | | |
| I: (20° C., 65%) | 25 | 18 | 63 | 150 |
| II: (30° C., 80%) | 8 | 20 | 85 | No sensitivity |
| Image Forming*4) Performance | | | | |
| I: (20° C., 65%) | good | good | Dm slightly low | Dm low, densities of fine line cut letter low |
| II: (30° C., 80%) | good | good | Dm slightly low | Dm low, densities of fine line cut letter low |
| Contact Angle*5) with Water (°C.) | 10 | 10 | 12 | 25–30 |
| Printing Durability*6) | 7,000 prints | 1,000 prints | 6,000 prints | background stain occurred from the 1st print |

The evaluation items in Table 12 were the same as those described above in Example 1.

In this case, however, the electrostatic characteristics were determined under the condition (I) of 20° C., 65% RH or the condition (II) of 30° C., 80% RH.

As shown in Table 12, it can be seen that the light-sensitive material of this invention was excellent in the surface smoothness of the photoconductive layer and electrostatic characteristics, and the reproduced images formed by processing had no background stains and had clear images. This is assumed to be based on the binder resin suitably adsorbed on the photoconductive particles and suitably covered the surface of the particles.

When the light-sensitive material was used as an offset master plate after process, the photoconductive layer was sufficiently oil-desensitized by an oil-desensitizing solution for the same reason as above, and the contact angle between the non-imaged portion and water was as low as 10 degrees, which showed that the layer was sufficiently rendered hydrophilic. At printing, 7,000 prints having no background stains were obtained even under the printing condition wherein the 1000th print was deteriorated in the case of using the light-sensitive material in Example 55.

On the other hand, the light-sensitive material in Example 55 wherein the resin (A) of the present invention was used alone without using the crosslinking agent showed very good electrostatic characteristics, but, when it was used for printing as an offset master plate after processing, the 1000th print showed deteriorated image quality.

Also, in the light-sensitive material in Comparison Example C wherein the resin having no grafted portion and having a carboxy group directly bonded at the straight chain was used, DRR in 90 seconds was reduced and $E_{1/10}$ was increased.

Also, in the light-sensitive material in Comparison Example D wherein the resin having an increased weight average molecular weight and having the chemical structure having a carboxy group directly at the straight chain as the resin in Comparison Example C was used without using a crosslinking agent, the electrostatic characteristics were greatly reduced. This is assumed that the increased molecular weight of the resin caused the aggregation of the photoconductive particles when the resin was adsorbed thereon thereby giving adverse effects.

Thus, the light-sensitive material only in the example of this invention showed satisfactory electrostatic characteristics and printing durability.

EXAMPLE 56

A mixture of 8 g of the aforesaid resin (A-31), 32 g of a resin (B-1) shown below, 200 g of zinc oxide, 0.02 g of the cyanine dye (III) used in Example 54, 0.40 g of phthalic anhydride, and 300 g of toluene was dispersed in a ball mill for 3 hours.

The dispersion was coated on a paper which had been subjected to an electroconductive treatment by a wire bar in a dry coating amount of 20 g/m$^2$ and dried for 15 seconds at 100° C. and then for one hour at 120° C. Then, the coated product was allowed to stand for 24 hours under the conditions of 20° C., 65% RH to prepare an electrophotographic light-sensitive material.

Resin (B-1):

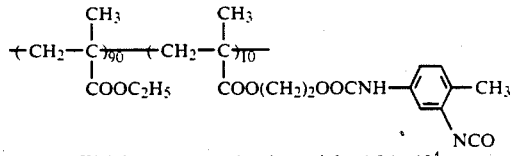

Weight average molecular weight: 6.5 × 10$^4$

As in Example 54, the characteristics of the sample were measured.

The results obtained are as follows.

| Smoothness of Photoconductive Layer: 135 (cc/sec.) Strength of Photoconductive Layer: 90% Electrostatic characteristics: | | | |
|---|---|---|---|
| | $V_{10}$(V) | D.R.R.(%) | $E_{1/10}$ (erg cm$^2$) |
| I (20° C., 65% RH): | −565 | 86 | 28 |
| II (30° C., 80% RH): | −550 | 80 | 32 |
| Imaging Property: | Good reproduced images were obtained under the condition of 20° C., 65% RH and the condition of 30° C., 80% RH. | | |
| Printing Durability: | 6,000 prints having good images were obtained. | | |

Thus, light-sensitive material having excellent electrophotographic characteristics and high printing durability could be obtained.

EXAMPLES 57 TO 64

A mixture of 6.5 g of each of resins (A) shown in Table 13 below, 33.5 g of each of resins (B) shown in Table 13 below, 200 g of zinc oxide, 0.018 g of a cyanine dye (IV) shown below, 0.30 g of maleic anhydride, and 300 g of toluene was dispersed in a ball mill for 3 hours. Then, after adding a predetermined amount of each of the crosslinking agents shown in Table 13 to the dispersion, the mixture was further dispersed in a ball mill for 10 minutes. The dispersion was coated on a paper which had been subjected to an electroconductive treatment by a wire bar in a dry coating amount of 20 g/m$^2$ and dried for 15 seconds at 100° C. and then for 2 hours at 120° C. Then, the coated product was allowed to stand in the dark for 24 hours to obtain each of the electrophotographic light-sensitive materials.

Cyanine Dye (IV):

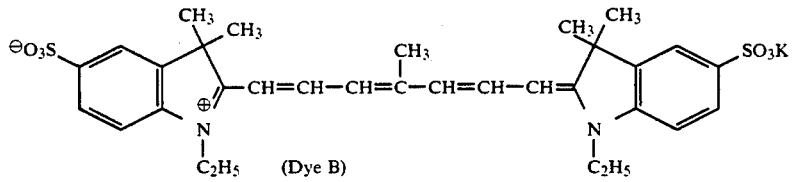

(Dye B)

TABLE 13

| Example | Resin (A) | Resin (B) | | Crosslinking Agent | |
|---|---|---|---|---|---|
| 57 | A-4 | 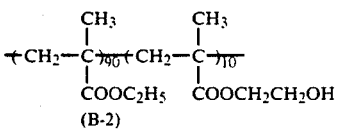 (B-2) | $\overline{M}_w$ 38,000 | 1,3-xylylenediisocyanate | 1.5 g |

TABLE 13-continued

| Example | Resin (A) | Resin (B) | | Crosslinking Agent | |
|---|---|---|---|---|---|
| 58 | A-5 | 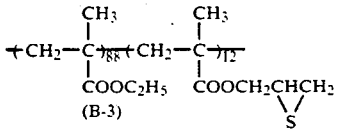 (B-3) | $\overline{M}w$ 40,000 | 1,6-hexamethylenediamine | 1.3 g |
| 59 | A-6 | 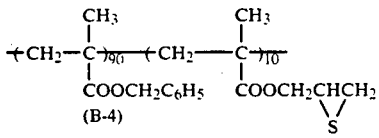 (B-4) | $\overline{M}w$ 41,000 | Terephthalic acid | 1.5 g |
| 60 | A-14 | 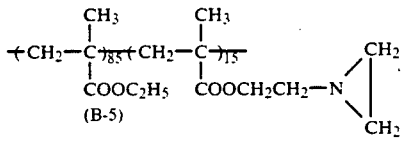 (B-5) | $\overline{M}w$ 38,000 | 1,4-tetramethylenediamine | 1.2 g |
| 61 | A-15 | 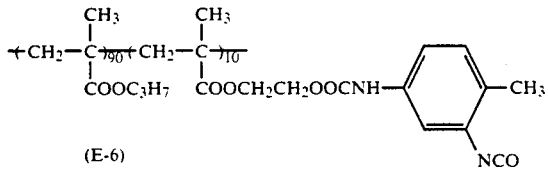 (E-6) | $\overline{M}w$ 37,000 | polyethylene glycol | 1.2 g |
| 62 | A-18 | " | | polypropylene glycol | 1.2 g |
| 63 | A-17 | 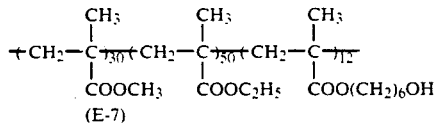 (E-7) | $\overline{M}w$ 42,000 | 1,6-hexamethylenediisocyanate | 2 g |
| 64 | A-33 | 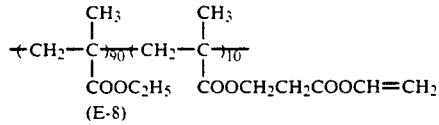 (E-8) | $\overline{M}w$ 55,000 | ethyleneglycoldimethacrylate | 2 g |

On these light-sensitive materials, the electrostatic characteristics were measured using the paper analyzer as in Example 54.

The light-sensitive materials of this invention were excellent in the charging property, dark change retentivity, and light-sensitivity and provided clear images having neither background stains nor fine line cutting under severe conditions (30° C., 80% RH) at practical imaging.

Also, when each of the light-sensitive materials was used as an offset master plate after processing, the photoconductive layer was sufficiently oil-desensitized by an oil-desensitizing solution and the contact angle between the non-image portion and water was as low as 15 degrees, which showed the photoconductive layer was sufficiently rendered hydrophilic.

When each master plate was used for printing, 6,000 to 7,000 prints having clear images and no background fog could be obtained.

EXAMPLES 65 TO 70

A mixture of 7 g of each of resins (A) in Table 14 below, 20 g of each of resins (B) in Group X shown in Table 14, 200 g of zinc oxide, 0.50 g of Rose Bengal, 0.25 g of bromophenol blue, 30 g of uranine, 0.30 g of phthalic anhydride, and 240 g of toluene was dispersed in a ball mill for 3 hours.

To the dispersion was added a solution of 13 g of each of resins (B) in Group Y shown in Table 14 dissolved in 80 g of toluene, and the mixture was further dispersed in a ball mill for 10 minutes.

The dispersion was coated on a paper which had been subjected to an electroconductive treatment by a wire bar in a dry coating amount of 18 g/m$^2$ and dried for 30 seconds at 110° C. and then for 2 hours at 120° C. Then, the coated material was allowed to stand for 24 hours under the conditions of 20° C., 65% RH to obtain each of electrophotographic light-sensitive materials.

TABLE 14

| Example | Resin (A) | Resin (B) Group X | Resin (B) Group Y |
|---|---|---|---|
| 65 | A-26 | 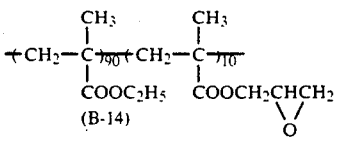 (B-14) $\overline{M}w$ 42,000 | 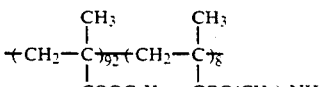 (B-15) $\overline{M}w$ 38,000 |
| 66 | A-29 | 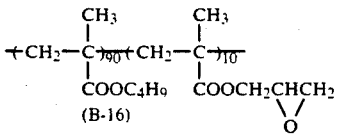 (B-16) $\overline{M}w$ 45,000 | (B-15) |
| 67 | A-23 | 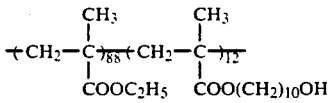 (B-17) $\overline{M}w$ 38,000 | 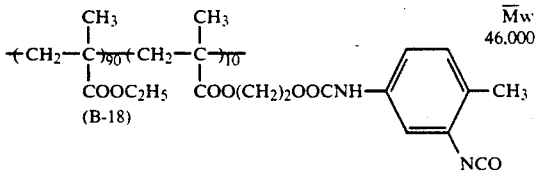 (B-18) $\overline{M}w$ 46,000 |
| 68 | A-20 | (B-14) | 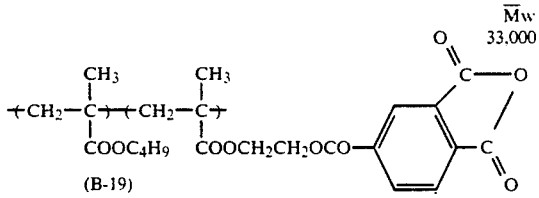 (B-19) $\overline{M}w$ 33,000 |
| 69 | A-12 | (B-17) | (B-19) |
| 70 | A-25 | (B-19) | (B-15) |

Each of the light-sensitive materials was excellent in the charging property, dark charge retentivity, and light sensitivity and provided clear images having no background fog under severe conditions of 30° C., 80% RH at practical imaging.

Furthermore, the light-sensitive material was used for printing as an offset master plate after processing, 6,000 to 7,000 prints having clear images were obtained.

In this case of making each printing plate, toner images were formed by a full automatic printing plate making machine ELP404V (trade name, manufactured by Fuji Photo Film Co., Ltd.) using ELP-T as the toner.

EXAMPLES 71 AND 72

A mixture of 8 g of each of resin (A-34) and (A-35) shown in Table 15, 32 g of each of resins (B) shown in Table 15, 200 g of zinc oxide, 0.02 g of uranine, 0.04 g of Rose Bengal, 0.03 g of bromophenol blue, 0.20 g of phthalic anhydride, and 300 g of toluene was dispersed in a ball mill for 2 hours.

The dispersion was coated on a paper which had been subjected to an electroconductive treatment by a wire bar in a dry coating amount of 20 g/m$^2$ and dried for one minute at 110° C. Then, after exposing the entire surface of the coated material for 3 minutes to the light from a high pressure mercury lamp, the coated material was allowed to stand for 24 hours in the dark under the conditions of 20° C., 65% RH to obtain each of electrophotographic light-sensitive materials.

The characteristics of the light-sensitive materials obtained are shown in Table 16 below.

TABLE 15

| Example No. | Resin (A) | Resin (B) |
|---|---|---|
| 71 | (A-35) | 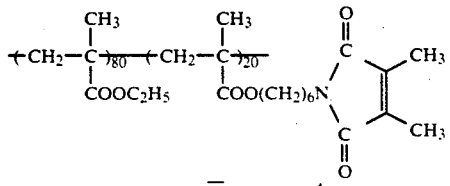 (B-20) $\overline{M}w$ 5.4 × 10$^4$ |

TABLE 15-continued

| Example No. | Resin (A) | Resin (B) |
|---|---|---|
| 72 | (A-34) | 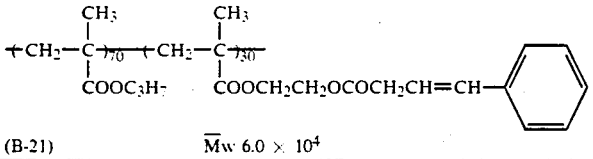 (B-21) $\overline{M}w$ 6.0 × $10^4$ |

TABLE 16

| | Example 71 | Example 72 |
|---|---|---|
| Smoothness (cc/sec) | 115 | 120 |
| Film Strength (%) | 88 | 85 |
| $V_{10}$ (−V) | 540 | 540 |
| D.R.R (%) | 82 | 82 |
| $E_{1/10}$ (lux · sec) | 10.2 | 11.0 |
| Printing Durability (No. of prints) | 6,500 | 6,000 |

The electrostatic characteristics shown in the above table were measured in the same manners as described in Examples 48 to 53.

In addition, the characteristics were measured under the conditions of 30° C., 80% RH.

The light-sensitive materials of this invention were excellent in the charging property, dark charge retentivity, and light-sensitivity and gave clear images having neither background fog nor fine line cutting under the severe conditions of 30° C., 80% RH at practical imaging.

Furthermore, when each sample was used for printing as an offset master plate after processing, 6,000 to 6,500 prints having clear images and no background fog could be obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material comprising a support having provided thereon a photoconductive layer containing at least inorganic photoconductive particles and a binder resin, wherein the binder resin comprises a graft-type copolymer formed from at least a monofunctional macromonomer (M) having a weight average molecular weight of not more than $2\times10^4$ and a monomer represented by the following formula (III), said macromonomer (M) comprising at least one polymer component represented by the following formulae (IIa) and (IIb) and at least one polymer component containing at least one polar group selected from —COOH, $—PO_3H_2$, $—SO_3H$, —OH, and

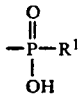

(wherein $R^1$ represents a hydrocarbon group or $—OR^2$ (wherein $R^2$ represents a hydrocarbon group)), and said macromonomer (M) having a polymerizable double bond group represented by the following formula (I) bonded to only one terminal of the main chain of the polymer;

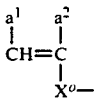

(I)

wherein $X^o$ represents —COO—, —OCO—, $—CH_2OCO—$, $—CH_2COO—$, —O—, $—SO_2—$, —CO—,

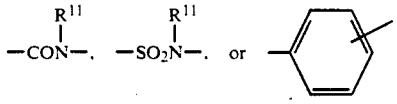

(wherein $R^{11}$ represents a hydrogen atom or a hydrocarbon group), and $a^1$ and $a^2$, which may be the same or different, each represents a hydrogen atom, a halogen atom, a cyano group, a hydrocarbon group, $—COO—Z^1$ or $—COO—Z^1$ bonded via a hydrocarbon group (wherein $Z^1$ represents a hydrogen atom or a hydrocarbon group which may be substituted);

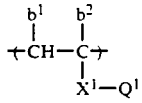

(IIa)

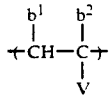

(IIb)

wherein $X^1$ has the same meaning as $X^o$ in formula (I); $Q^1$ represents an aliphatic group having from 1 to 18 carbon atoms or an aromatic group having from 6 to 12 carbon atoms; $b^1$ and $b^2$, which may be the same or different have the same meaning as $a^1$ and $a^2$ in formula (I); and V represents —CN, $—CONH_2$, or

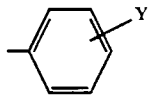

wherein Y represents a hydrogen atom, a halogen atom, an alkoxy group or $—COOZ^2$ (wherein $Z^2$ represents an alkyl group, an aralkyl group, or an aryl group));

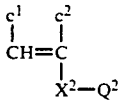

(III)

wherein $X^2$ has the same meaning as $X^o$ in formula (I); $Q^2$ has the same meaning as $Q^1$ in formula (IIa); and $c^1$ and $c_2$, which may be the same of different, have the same meaning as $a^1$ and $a^2$ in formula (I).

2. The electrophotographic light-sensitive material as in claim 1, wherein the copolymer has at least one polar group selected from $—PO_3H_2$, $—SO_3H$ and —COOH bonded at the terminal of the main chain of the copolymer.

3. The electrophotographic light-sensitive material as in claim 1, wherein said copolymer has a weight average molecular weight of from $1\times10^3$ to $5\times10^5$.

4. The electrophotographic light-sensitive material as in claim 1, wherein said copolymer has a weight average molecular weight of from $1\times10^3$ to $2\times10^4$ and said binder resin further contains a resin (B) which has a weight average molecular weight of from $5\times10^4$ to $5\times10^5$ and which does not contain $—PO_3H_2$, $—SO_3H$, $—CO_2H$, —OH,

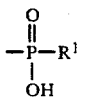

(wherein $R^1$ is the same as defined above) and a basic group.

5. The electrophotographic light-sensitive material as in claim 1, wherein said copolymer has a weight average molecular weight of from $1\times10^3$ to $2\times10^4$, and said binder resin further contains a resin (C) which has a weight average molecular weight of from $5\times10^4$ to $5\times10^5$ and which contains from 0.1 to 15% by weight a copolymer component having at least one functional group selected from —OH and a basic group.

6. The electrophotographic light-sensitive material as in claim 1, wherein said copolymer has a weight average molecular weight of from $5\times10^4$ to $5\times10^5$, and said binder resin further contains a resin (D) which has a weight average molecular weight of from $5\times10^4$ to $5\times10^5$ and contains a copolymer having a polar group at a content of not more than 50% of the content of the acid group contained in the copolymer or a resin having a weight average molecular weight of from $5\times10^4$ to $5\times10^5$ and contains a copolymer having at least one polar group selected from $—PO_3H_2$, $—SO_3H$, —COOH, and

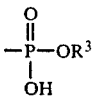

(wherein $R^3$ represents a hydrocarbon group), said polar group having a pKa value higher than the pKa of the polar group contained in said copolymer.

7. The electrophotographic light-sensitive material as in claim 1, wherein the binder resin further contains at least one of a heat- and/or photo-curable resin (E) having a crosslinking functional group and a crosslinking agent.

8. The electrophotographic light-sensitive material as in claim 1, wherein macromonomer (M) has a weight average molecular weight of from $1\times10^3$ to $2\times10^4$.

* * * * *